US007066555B2

(12) United States Patent
Hansen et al.

(10) Patent No.: US 7,066,555 B2
(45) Date of Patent: Jun. 27, 2006

(54) REINFORCED CONCRETE MILLING/CUTTING MANDREL

(75) Inventors: Terry Hansen, Pleasant Grove, UT (US); J. Tron Haroldsen, Herriman, UT (US); Jeremy Nix, Provo, UT (US)

(73) Assignee: Asphalt Zipper, Inc., Pleasant Grove, UT (US)

( * ) Notice: Subject to any disclaimer, the term of this patent is extended or adjusted under 35 U.S.C. 154(b) by 0 days.

(21) Appl. No.: 10/927,864

(22) Filed: Aug. 26, 2004

(65) Prior Publication Data

US 2005/0077776 A1 Apr. 14, 2005

Related U.S. Application Data

(60) Provisional application No. 60/497,860, filed on Aug. 26, 2003.

(51) Int. Cl.
*E01C 23/12* (2006.01)

(52) U.S. Cl. ..... 299/39.8; 299/87.1

(58) Field of Classification Search ..... 299/39.8, 299/87.1

See application file for complete search history.

(56) References Cited

U.S. PATENT DOCUMENTS 4,006,936 A * 2/1977 Crabiel ..... 299/39.8
4,659,250 A 4/1987 Nelson ..... 404/90
5,026,205 A 6/1991 Gorski et al. ..... 404/72
5,052,757 A * 10/1991 Latham ..... 299/87.1
5,388,893 A 2/1995 Maxwell et al. ..... 299/39
5,647,641 A * 7/1997 Sulosky et al. ..... 299/39.8
5,664,907 A 9/1997 Betsinger ..... 404/90
5,775,781 A * 7/1998 Sawtelle et al. ..... 299/39.8
5,904,408 A * 5/1999 Olson et al. ..... 299/87.1
6,547,484 B1 * 4/2003 Murphy ..... 404/124
6,764,140 B1 * 7/2004 Carson et al. ..... 299/79.1
6,779,850 B1 * 8/2004 Schibeci et al. ..... 299/87.1
6,832,818 B1 * 12/2004 Luciano ..... 299/39.8

* cited by examiner

*Primary Examiner*—John Kreck
(74) *Attorney, Agent, or Firm*—Michael F. Krieger; Kirton & McConkie

(57) ABSTRACT

In accordance with the invention as embodied and broadly described herein, the present invention features a milling mandrel attachable to a milling device and comprising a primary cylindrical barrel; a plurality of cutting bits removably attached to the primary barrel and arranged about a support base within a cutting/sawing area or segment or sector defined on the primary barrel, wherein the cutting bits are arranged in a predetermined bit pattern via a bit location system and patterned cutting bit system; and a plurality of chunking or milling bits also removably attached to the primary barrel and arranged within a chunking or milling area or segment or sector also defined on the primary barrel and adjacent and operable with each of the cutting or sawing sectors.

38 Claims, 28 Drawing Sheets

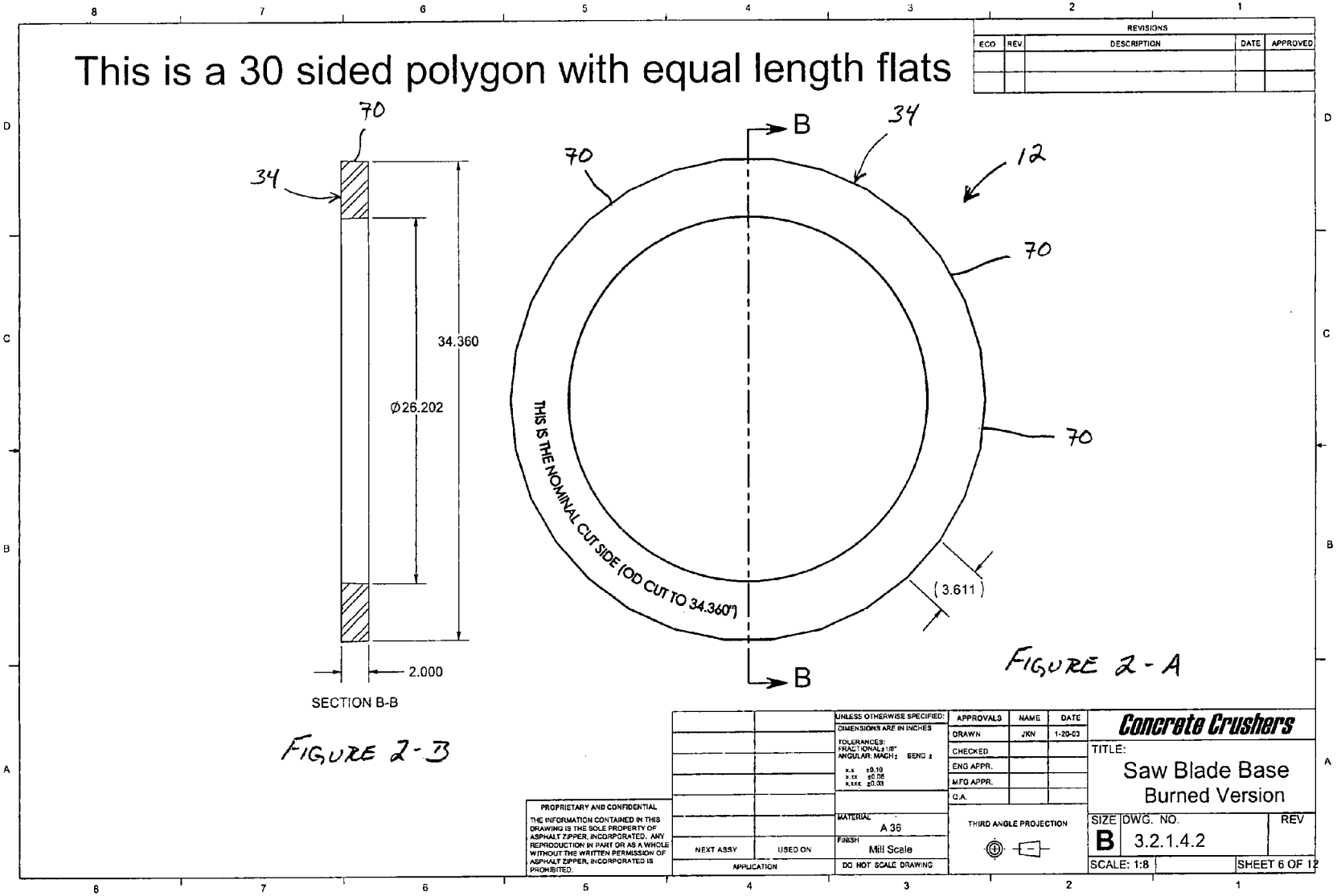
This is a 30 sided polygon with equal length flats
REVISIONS
ECO
REV
DESCRIPTION
DATE
APPROVED
12
70
34
B
(3.611)
THIS IS THE NOMINAL CUT SIDE (OD CUT TO 34.360")
34.360
Ø26.202
2.000
SECTION B-B
FIGURE 2-A
FIGURE 2-B
Concrete Crushers
TITLE:
Saw Blade Base
Burned Version
SIZE
DWG. NO.
B
3.2.1.4.2
REV
SCALE: 1:8
SHEET 6 OF 12
APPROVALS
NAME
DATE
DRAWN
JKN
1-20-03
CHECKED
ENG APPR.
MFG APPR.
Q.A.
THIRD ANGLE PROJECTION
UNLESS OTHERWISE SPECIFIED:
DIMENSIONS ARE IN INCHES
MATERIAL
A 36
FINISH
Mill Scale
DO NOT SCALE DRAWING
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.

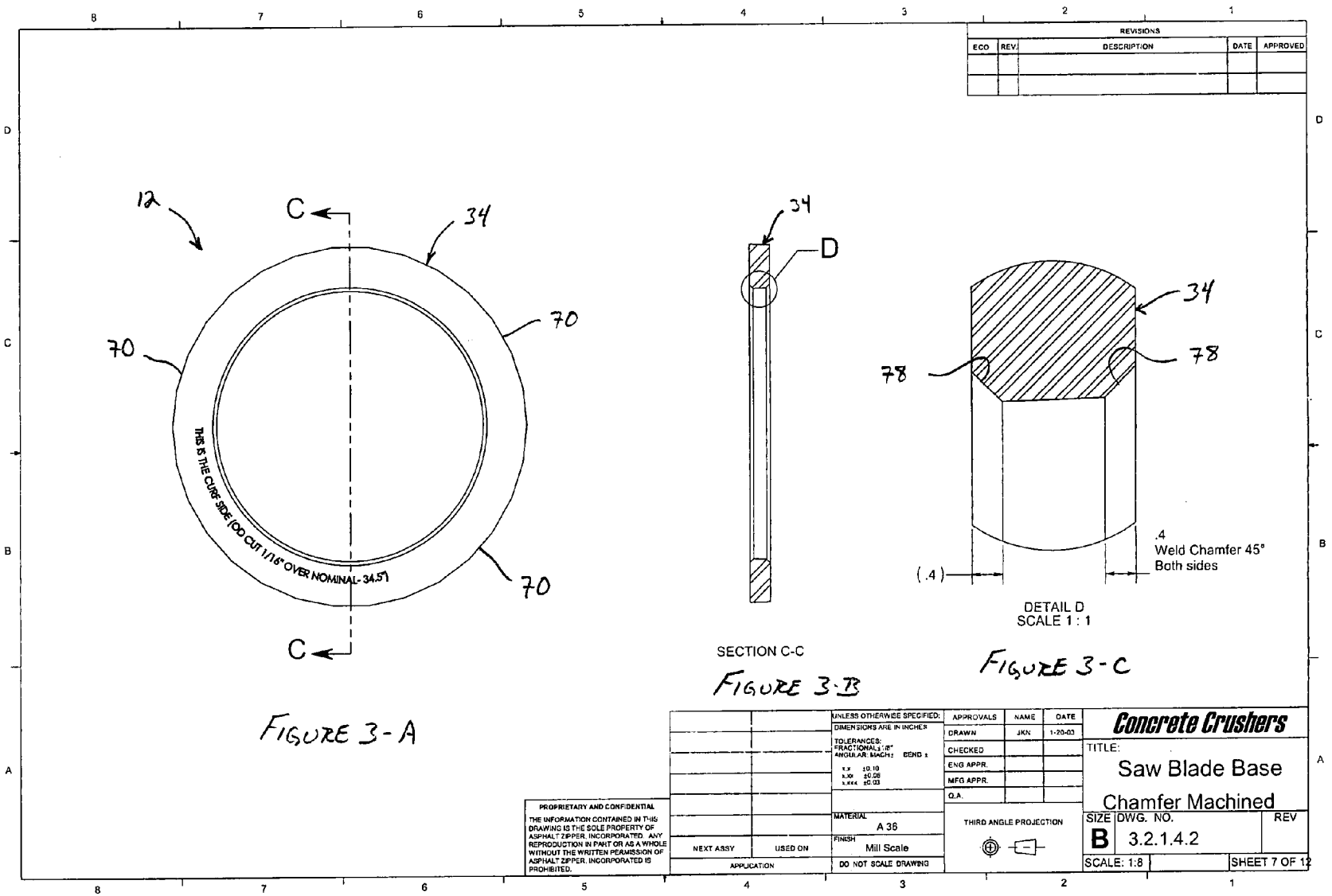
REVISIONS
ECO
REV.
DESCRIPTION
DATE
APPROVED
34
78
.4
Weld Chamfer 45°
Both sides
DETAIL D
SCALE 1 : 1
FIGURE 3-C
78
(.4)
D
34
SECTION C-C
FIGURE 3-B
UNLESS OTHERWISE SPECIFIED:
DIMENSIONS ARE IN INCHES
TOLERANCES:
FRACTIONAL ±1/8"
ANGULAR: MACH ±
BEND ±
APPROVALS
NAME
DATE
DRAWN
JKN
1-20-03
CHECKED
ENG APPR.
MFG APPR.
Q.A.
THIRD ANGLE PROJECTION
MATERIAL
A 36
FINISH
Mill Scale
NEXT ASSY
USED ON
APPLICATION
DO NOT SCALE DRAWING
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.
Concrete Crushers
TITLE:
Saw Blade Base
Chamfer Machined
SIZE
B
DWG. NO.
3.2.1.4.2
REV
SCALE: 1:8
SHEET 7 OF 12
70
34
C
C
THIS IS THE CURB SIDE (OD CUT 1/16" OVER NOMINAL-34.5")
12
70
70
FIGURE 3-A

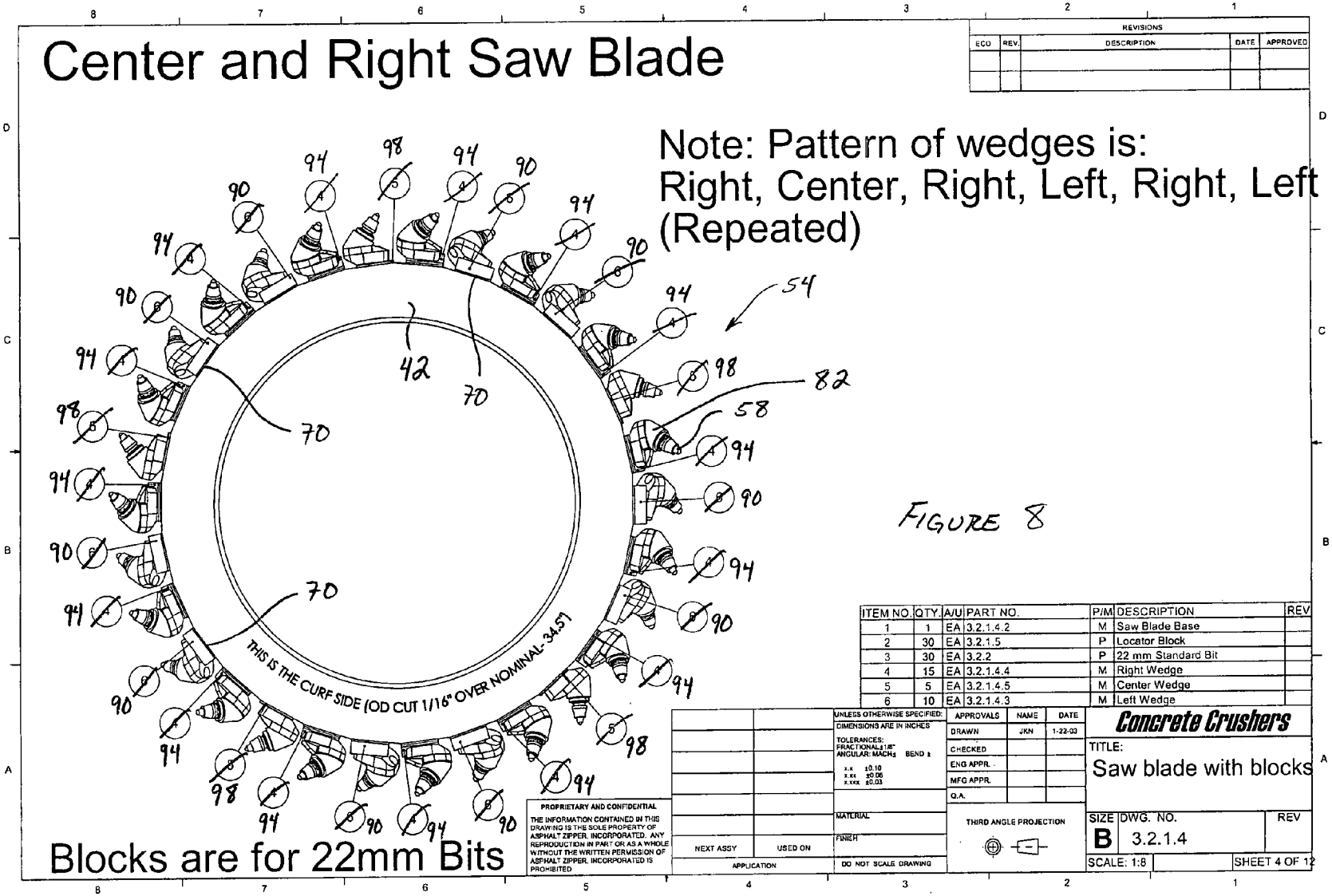
Center and Right Saw Blade
Note: Pattern of wedges is:
Right, Center, Right, Left, Right, Left
(Repeated)
Blocks are for 22mm Bits
THIS IS THE CURF SIDE (OD CUT 1/16" OVER NOMINAL-34.5")
54
82
58
42
70
90
94
98
FIGURE 8
REVISIONS
ECO
REV
DESCRIPTION
DATE
APPROVED
ITEM NO. QTY. A/U PART NO. P/M DESCRIPTION REV
1 1 EA 3.2.1.4.2 M Saw Blade Base
2 30 EA 3.2.1.5 P Locator Block
3 30 EA 3.2.2 P 22 mm Standard Bit
4 15 EA 3.2.1.4.4 M Right Wedge
5 5 EA 3.2.1.4.5 M Center Wedge
6 10 EA 3.2.1.4.3 M Left Wedge
UNLESS OTHERWISE SPECIFIED:
DIMENSIONS ARE IN INCHES
TOLERANCES:
FRACTIONAL ±1/64"
ANGULAR: MACH ± BEND ±
X.X ±0.10
X.XX ±0.05
X.XXX ±0.03
MATERIAL
FINISH
DO NOT SCALE DRAWING
APPROVALS NAME DATE
DRAWN JKN 1-22-03
CHECKED
ENG APPR.
MFG APPR.
Q.A.
THIRD ANGLE PROJECTION
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.
Concrete Crushers
TITLE:
Saw blade with blocks
SIZE
B
DWG. NO.
3.2.1.4
REV
SCALE: 1:8
SHEET 4 OF 12

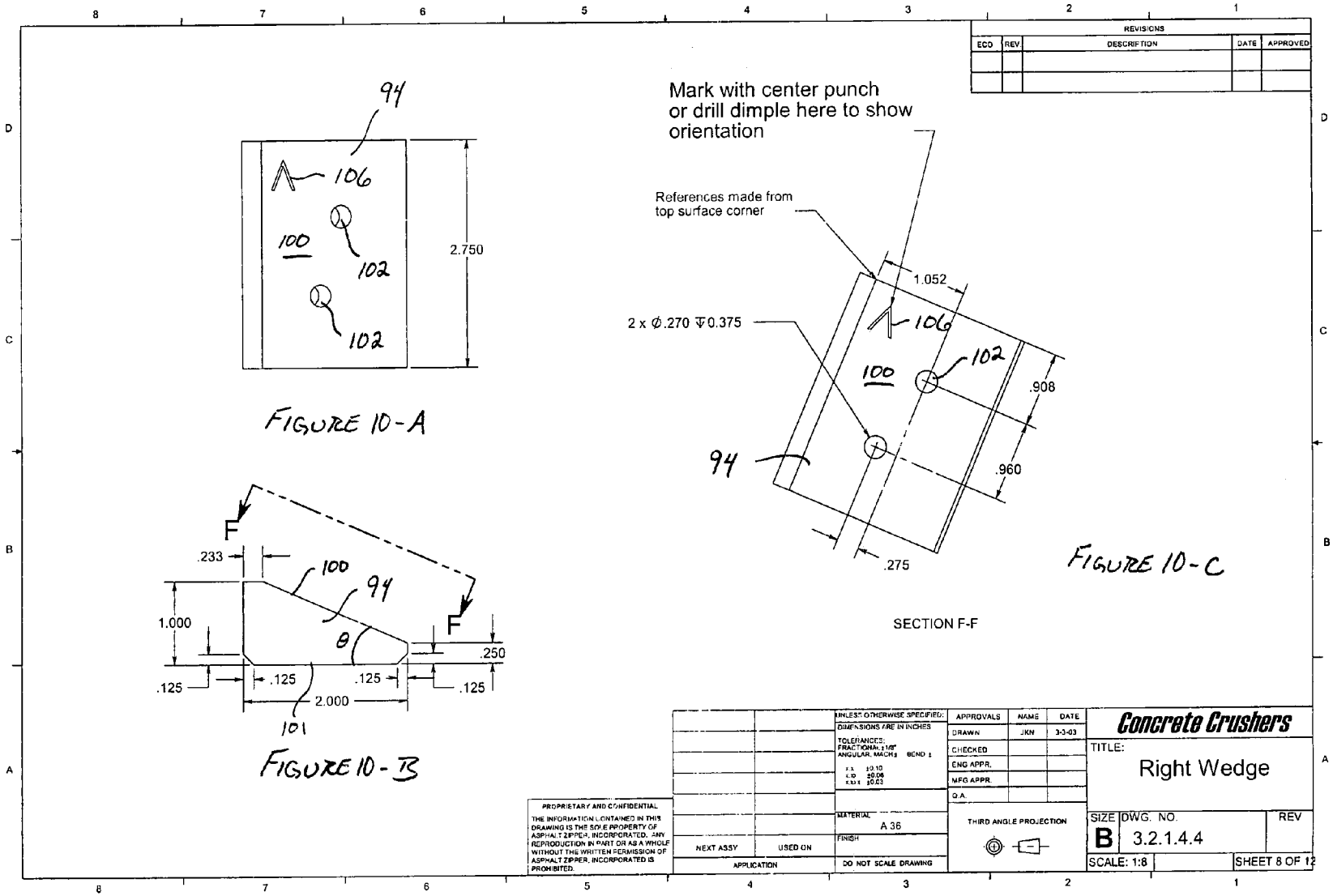
Mark with center punch or drill dimple here to show orientation
References made from top surface corner
2 x Φ.270 ∓0.375
1.052
.908
.960
.275
SECTION F-F
FIGURE 10-C
2.750
FIGURE 10-A
.250
.125
2.000
.233
1.000
FIGURE 10-B
Concrete Crushers
TITLE:
Right Wedge
SIZE B
DWG. NO. 3.2.1.4.4
REV
SCALE: 1:8
SHEET 8 OF 12
THIRD ANGLE PROJECTION
DO NOT SCALE DRAWING
REVISIONS
ECO
REV
DESCRIPTION
DATE
APPROVED

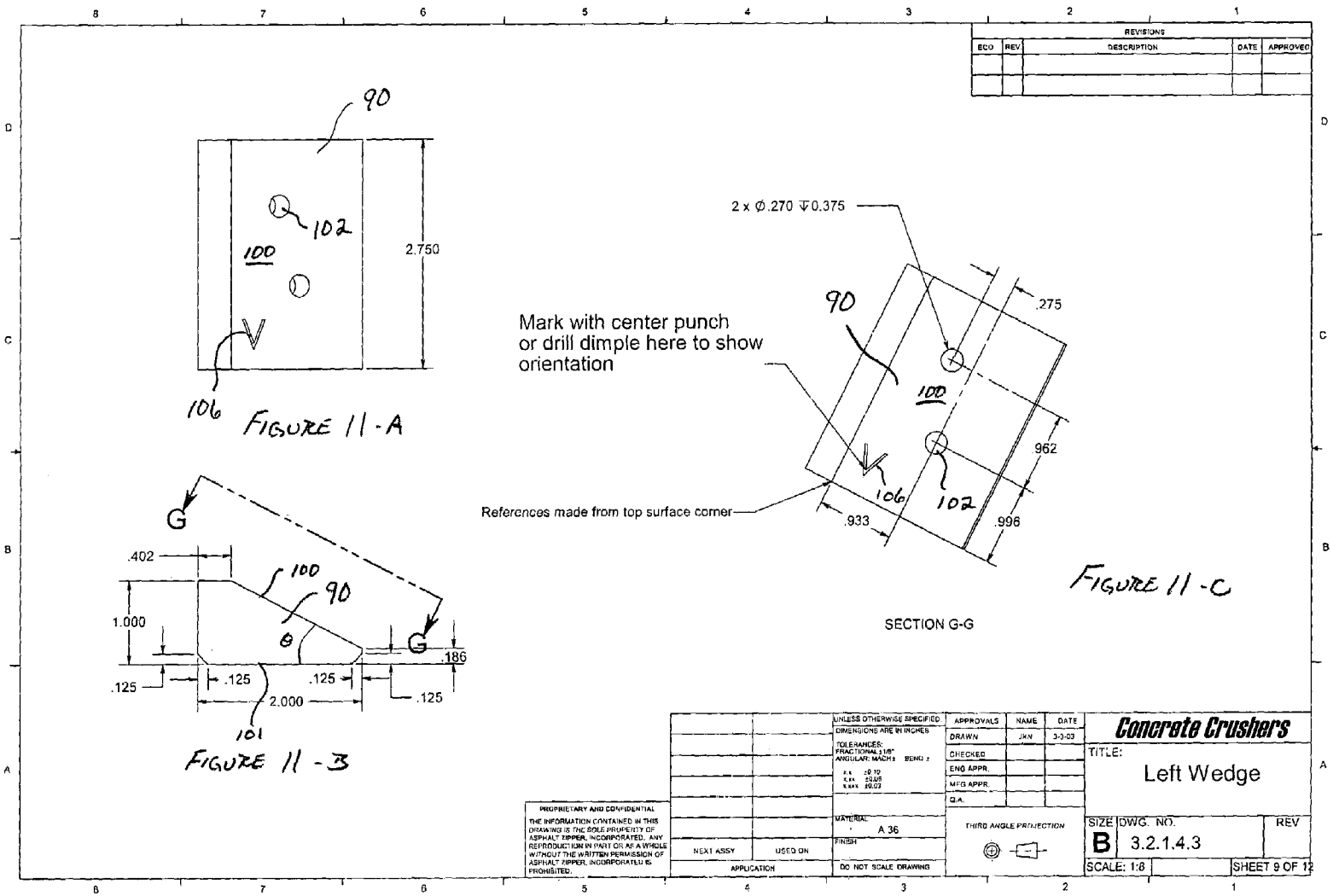
REVISIONS
ECO
REV
DESCRIPTION
DATE
APPROVED
.275
.962
.996
.933
2 x Ø.270 ∓0.375
Mark with center punch or drill dimple here to show orientation
References made from top surface corner
SECTION G-G
FIGURE 11-C
Concrete Crushers
TITLE:
Left Wedge
SIZE
B
DWG. NO.
3.2.1.4.3
REV
SCALE: 1:8
SHEET 9 OF 12
APPROVALS
DRAWN
CHECKED
ENG APPR.
MFG APPR.
Q.A.
NAME
DATE
THIRD ANGLE PROJECTION
MATERIAL
A 36
FINISH
DO NOT SCALE DRAWING
NEXT ASSY
USED ON
APPLICATION
PROPRIETARY AND CONFIDENTIAL
2.750
FIGURE 11-A
.186
.125
2.000
1.000
.402
FIGURE 11-B

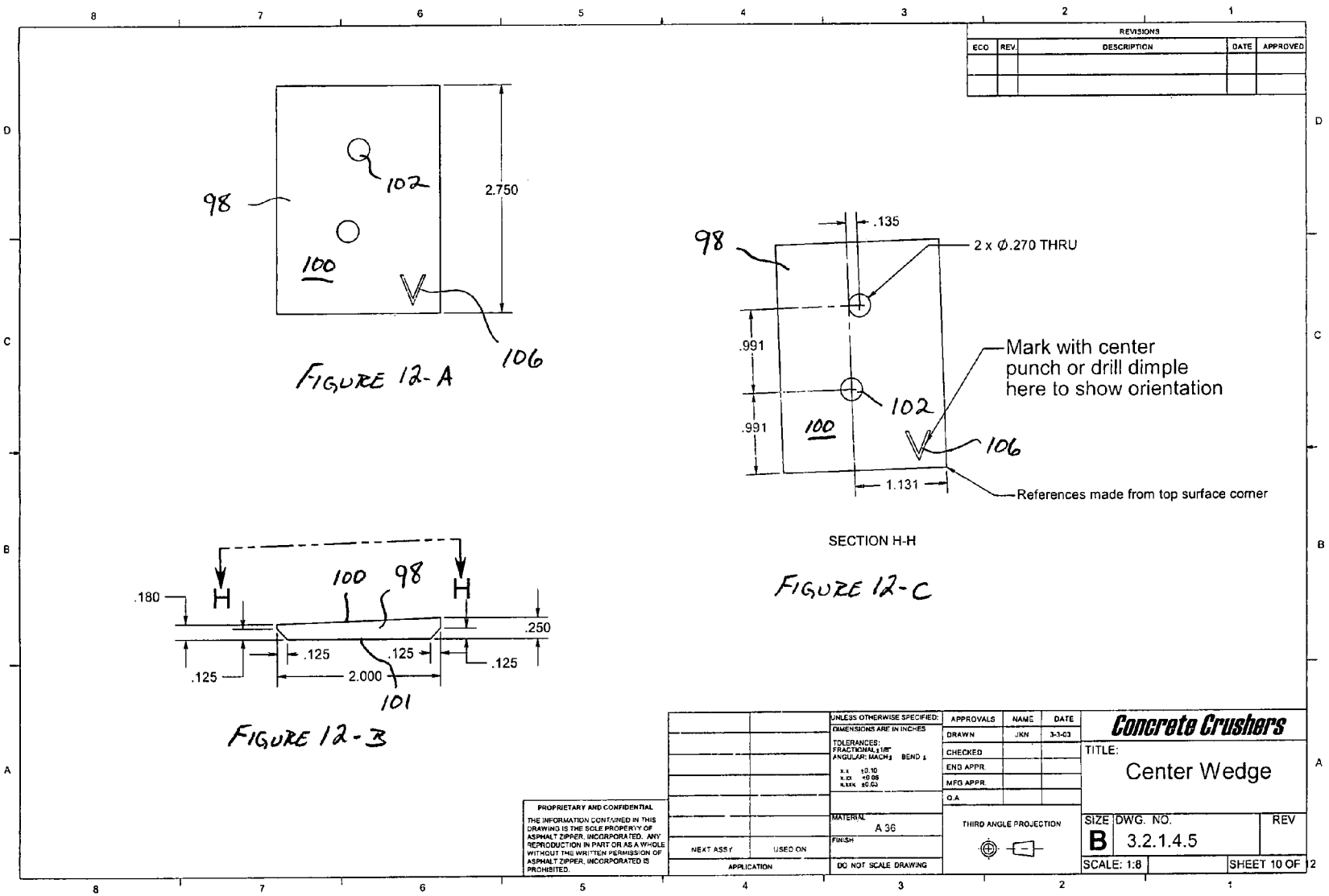
REVISIONS
ECO
REV.
DESCRIPTION
DATE
APPROVED
2 x Ø.270 THRU
Mark with center punch or drill dimple here to show orientation
References made from top surface corner
.135
1.131
.991
.991
98
100
102
106
SECTION H-H
FIGURE 12-C
2.750
FIGURE 12-A
.250
.125
.125
.125
.125
2.000
.180
101
FIGURE 12-B
Concrete Crushers
TITLE:
Center Wedge
SIZE
B
DWG. NO.
3.2.1.4.5
REV
SCALE: 1:8
SHEET 10 OF 12
UNLESS OTHERWISE SPECIFIED:
DIMENSIONS ARE IN INCHES
TOLERANCES:
FRACTIONAL ±
ANGULAR: MACH ± BEND ±
X.X ±0.10
X.XX ±0.08
X.XXX ±0.02
APPROVALS
NAME
DATE
DRAWN
JKN
3-3-03
CHECKED
ENG APPR.
MFG APPR.
Q.A.
THIRD ANGLE PROJECTION
MATERIAL
A 36
FINISH
DO NOT SCALE DRAWING
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.

* Alt. Emb.

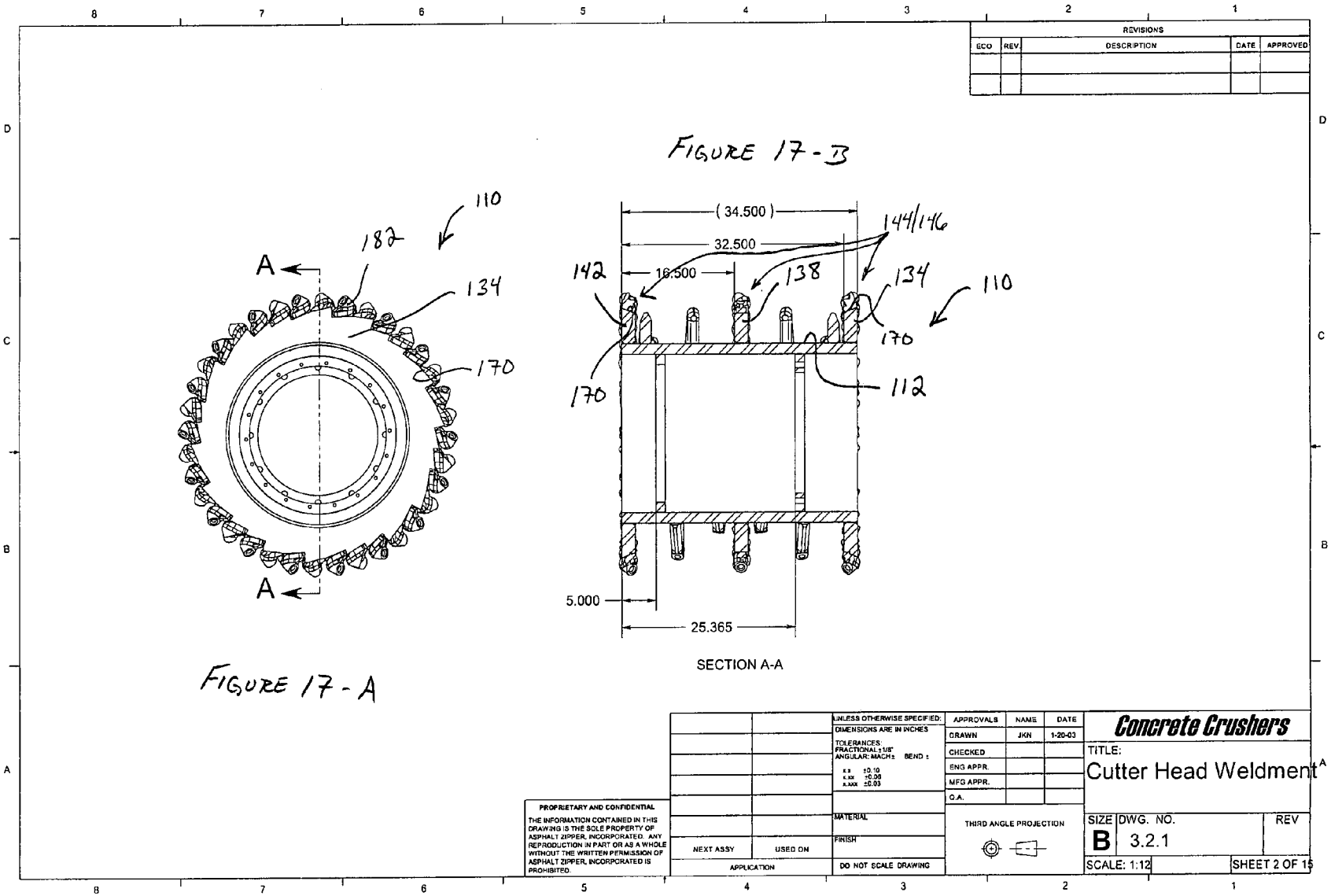
FIGURE 17-B
FIGURE 17-A

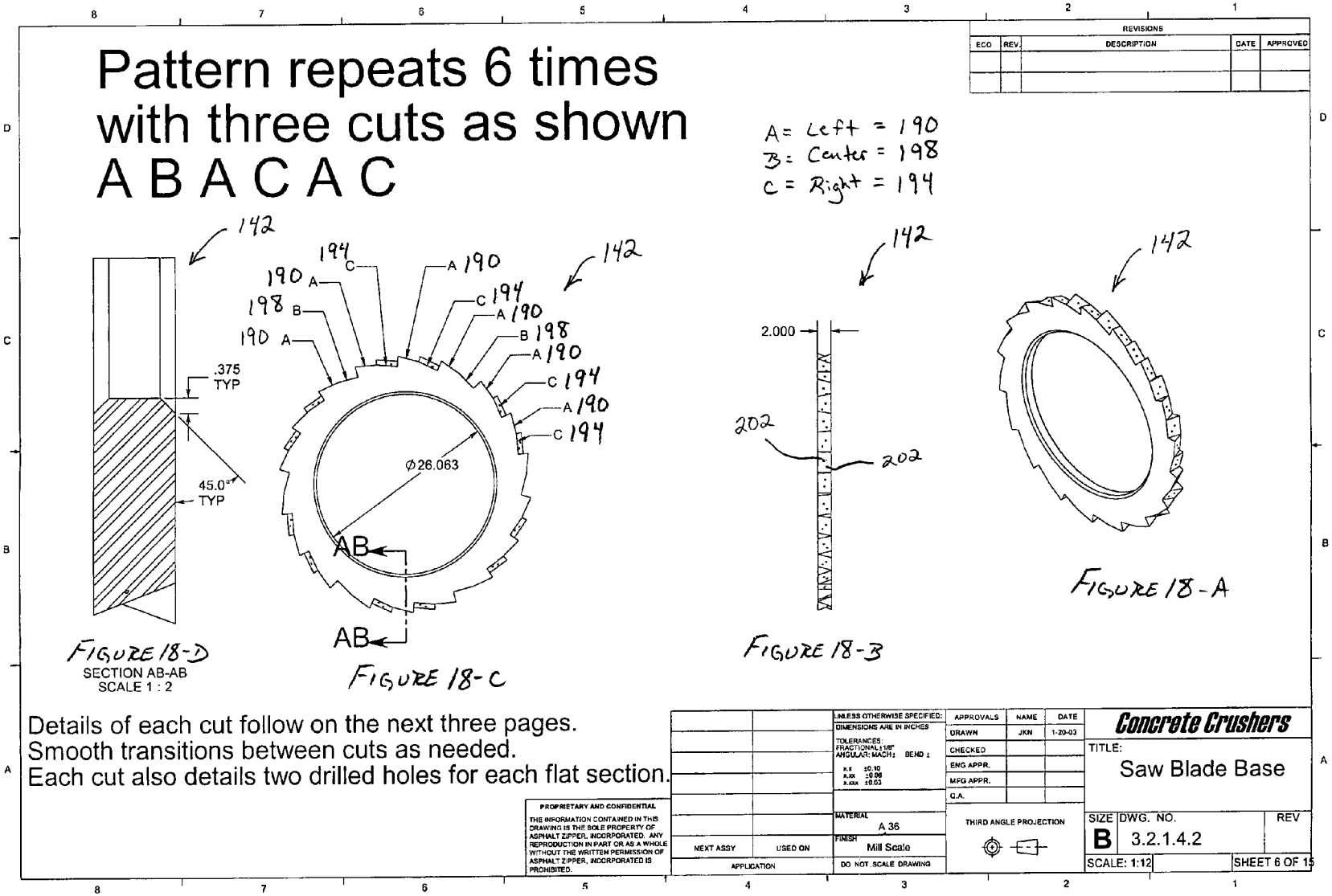
Pattern repeats 6 times
with three cuts as shown
A B A C A C
A = Left = 190
B = Center = 198
C = Right = 194
142
202
2.000
FIGURE 18-A
FIGURE 18-B
FIGURE 18-C
FIGURE 18-D
SECTION AB-AB
SCALE 1 : 2
.375 TYP
45.0° TYP
Ø26.063
AB
Details of each cut follow on the next three pages.
Smooth transitions between cuts as needed.
Each cut also details two drilled holes for each flat section.
Concrete Crushers
TITLE:
Saw Blade Base
SIZE B
DWG. NO. 3.2.1.4.2
REV
SCALE: 1:12
SHEET 6 OF 15
THIRD ANGLE PROJECTION
MATERIAL A 36
FINISH Mill Scale
DO NOT SCALE DRAWING
PROPRIETARY AND CONFIDENTIAL
THE INFORMATION CONTAINED IN THIS DRAWING IS THE SOLE PROPERTY OF ASPHALT ZIPPER, INC. ANY REPRODUCTION IN PART OR AS A WHOLE WITHOUT THE WRITTEN PERMISSION OF ASPHALT ZIPPER, INC. IS PROHIBITED.
REVISIONS
ECO
REV.
DESCRIPTION
DATE
APPROVED

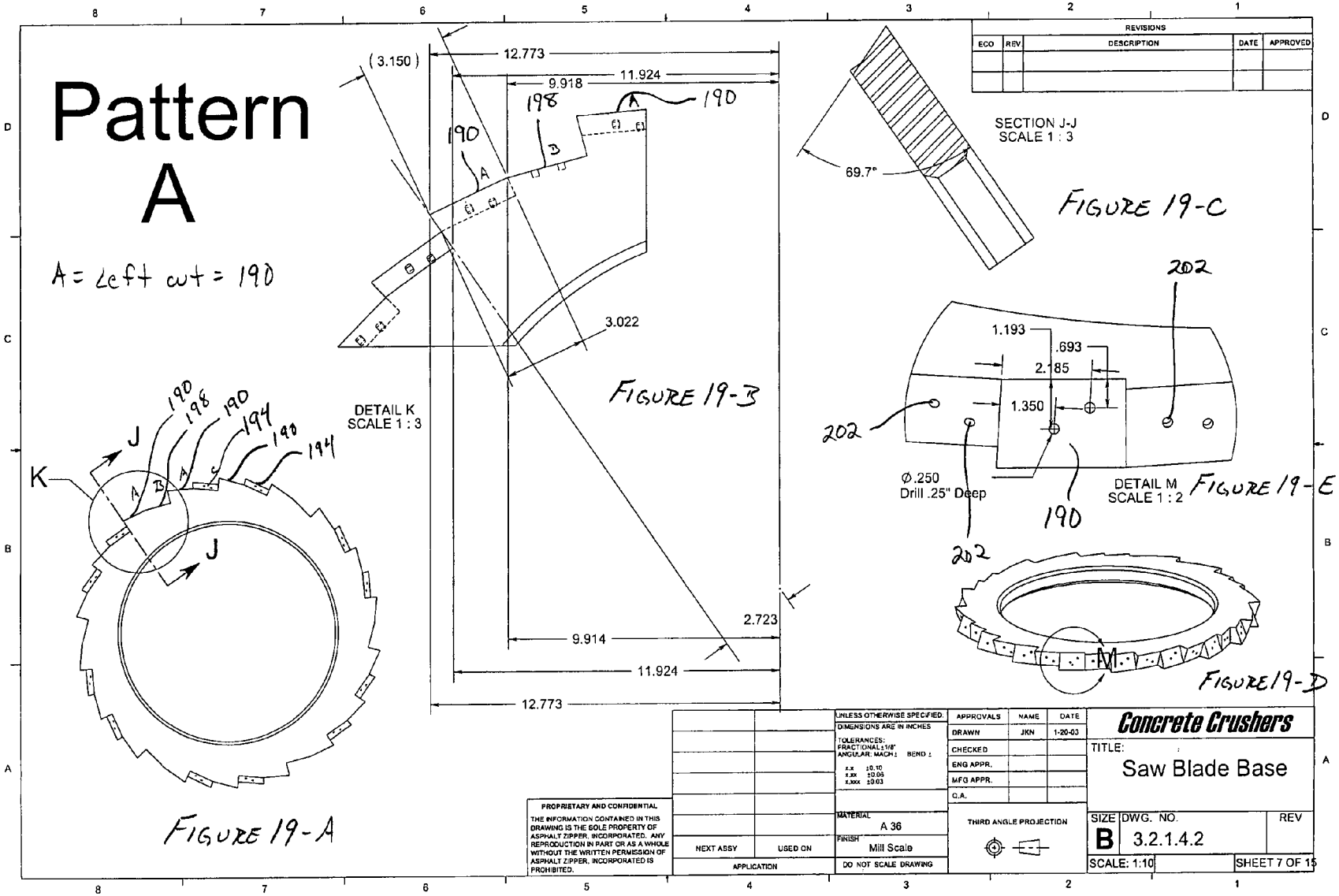
Pattern A
A = Left cut = 190
FIGURE 19-A
FIGURE 19-B
FIGURE 19-C
FIGURE 19-D
FIGURE 19-E
SECTION J-J SCALE 1 : 3
69.7°
DETAIL K SCALE 1 : 3
DETAIL M SCALE 1 : 2
Ø.250 Drill .25" Deep
202
190
198
12.773
11.924
9.918
3.022
2.723
9.914
(3.150)
1.193
.693
2.185
1.350
REVISIONS
ECO
REV
DESCRIPTION
DATE
APPROVED
UNLESS OTHERWISE SPECIFIED DIMENSIONS ARE IN INCHES
APPROVALS
NAME
DATE
DRAWN
JKN
1-20-03
CHECKED
ENG APPR.
MFG APPR.
Q.A.
THIRD ANGLE PROJECTION
MATERIAL A 36
FINISH Mill Scale
DO NOT SCALE DRAWING
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.
Concrete Crushers
TITLE:
Saw Blade Base
SIZE B
DWG. NO. 3.2.1.4.2
REV
SCALE: 1:10
SHEET 7 OF 15

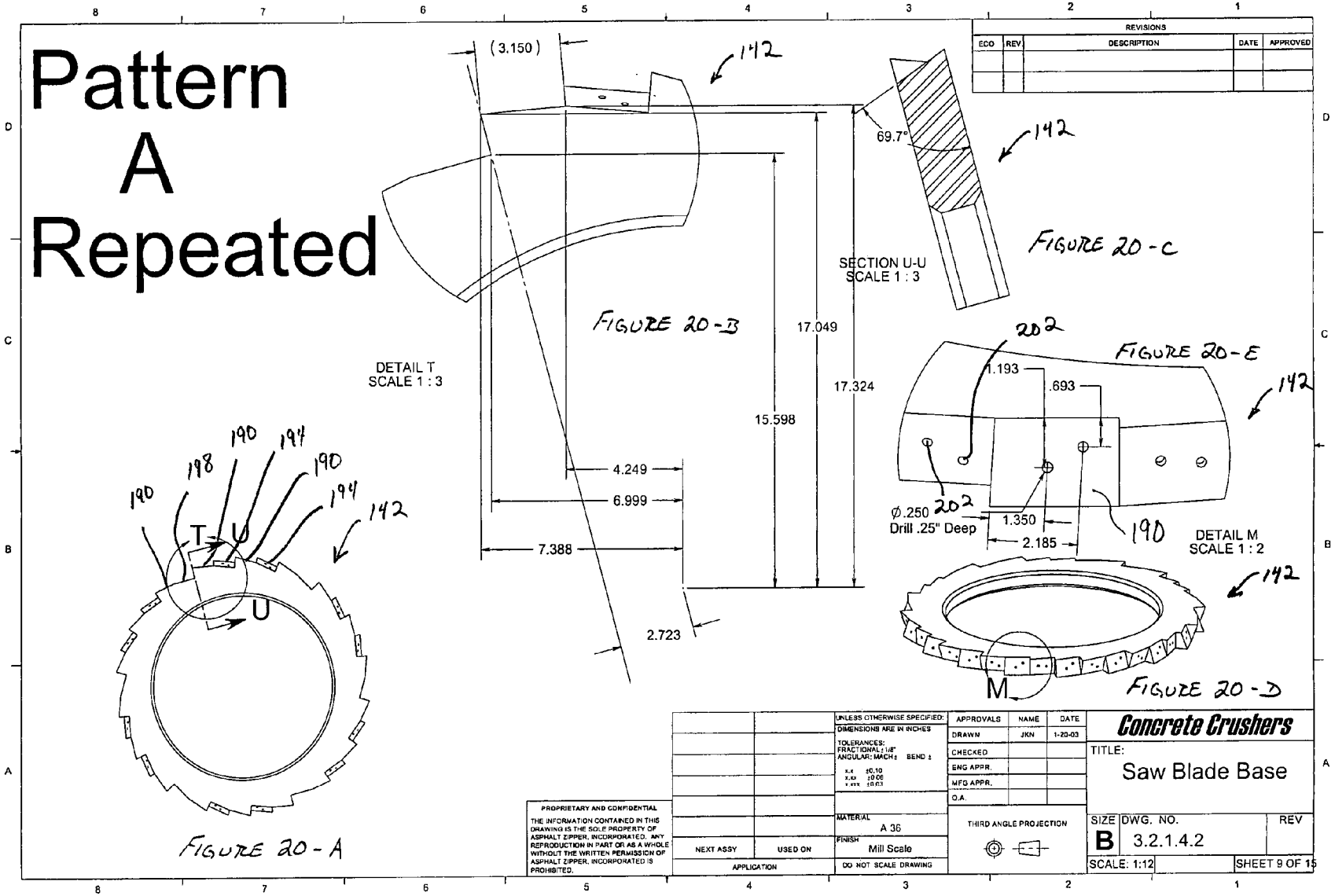
Pattern A Repeated
FIGURE 20-A
FIGURE 20-B
FIGURE 20-C
FIGURE 20-D
FIGURE 20-E
SECTION U-U SCALE 1:3
DETAIL T SCALE 1:3
DETAIL M SCALE 1:2
69.7°
17.324
17.049
15.598
(3.150)
4.249
6.999
7.388
2.723
.693
1.193
1.350
2.185
ø.250 Drill .25" Deep
142
190
194
198
202
T
U
M
REVISIONS
ECO
REV
DESCRIPTION
DATE
APPROVED
Concrete Crushers
TITLE:
Saw Blade Base
SIZE
B
DWG. NO.
3.2.1.4.2
REV
SCALE: 1:12
SHEET 9 OF 15
UNLESS OTHERWISE SPECIFIED:
DIMENSIONS ARE IN INCHES
TOLERANCES:
FRACTIONAL ±
ANGULAR: MACH ± BEND ±
APPROVALS
NAME
DATE
DRAWN
JKN
1-20-03
CHECKED
ENG APPR.
MFG APPR.
Q.A.
THIRD ANGLE PROJECTION
MATERIAL
A 36
FINISH
Mill Scale
DO NOT SCALE DRAWING
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.

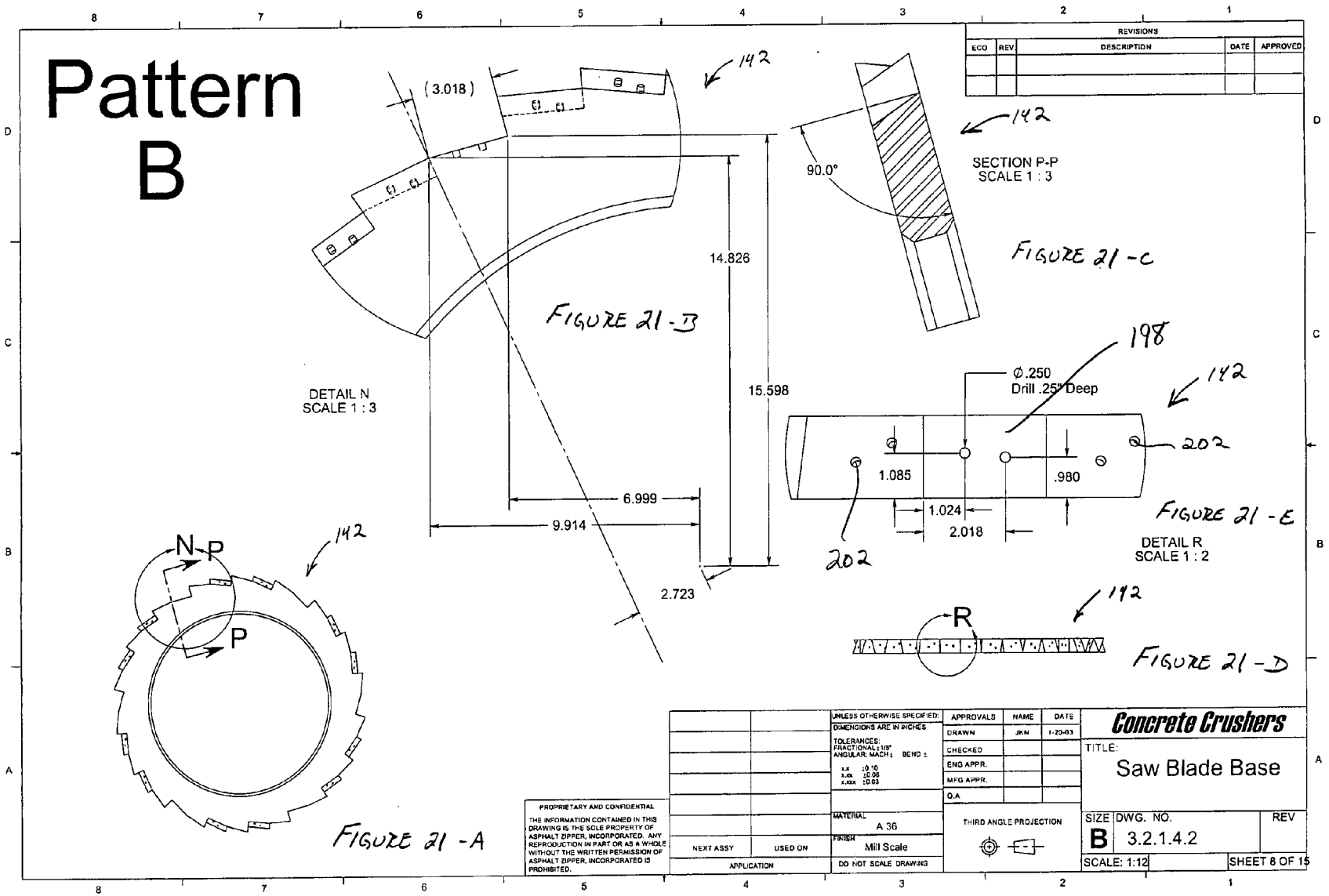
Pattern B
SECTION P-P
SCALE 1 : 3
FIGURE 21-C
90.0°
DETAIL N
SCALE 1 : 3
FIGURE 21-B
(3.018)
15.598
14.826
6.999
9.914
2.723
Ø.250
Drill .25" Deep
.980
1.024
2.018
1.085
DETAIL R
SCALE 1 : 2
FIGURE 21-E
FIGURE 21-D
FIGURE 21-A
142
198
202
Concrete Crushers
TITLE:
Saw Blade Base
SIZE B
DWG. NO. 3.2.1.4.2
REV
SCALE: 1:12
SHEET 8 OF 15
THIRD ANGLE PROJECTION
MATERIAL A 36
FINISH Mill Scale
DO NOT SCALE DRAWING
NEXT ASSY
USED ON
APPLICATION
DRAWN
CHECKED
ENG APPR.
MFG APPR.
Q.A.
NAME
DATE
REVISIONS
ECO
REV
DESCRIPTION
DATE
APPROVED

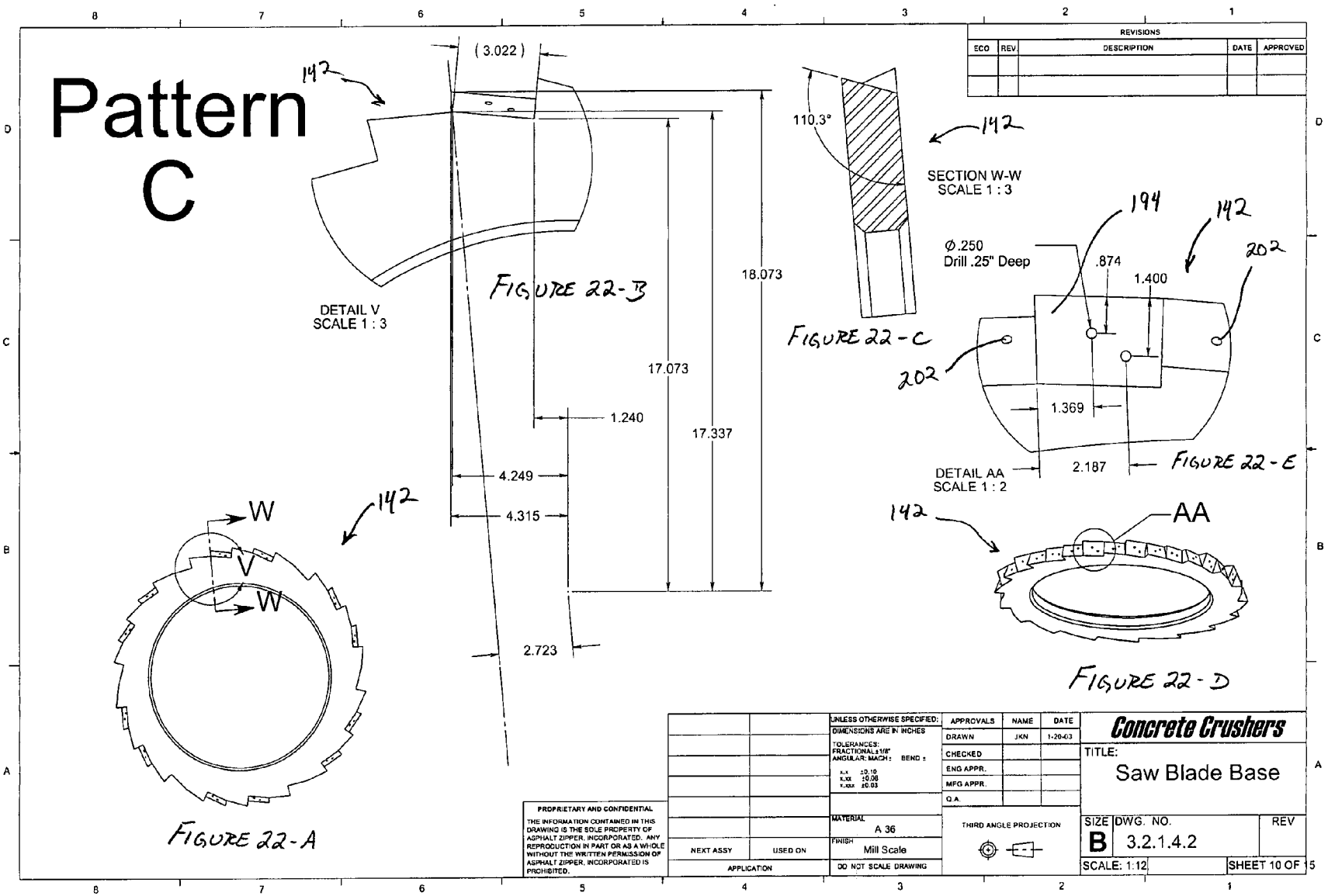
Pattern C
REVISIONS
ECO
REV
DESCRIPTION
DATE
APPROVED
SECTION W-W
SCALE 1 : 3
110.3°
FIGURE 22-C
Ø.250
Drill .25" Deep
.874
1.400
1.369
2.187
FIGURE 22-E
DETAIL AA
SCALE 1 : 2
AA
FIGURE 22-D
18.073
17.337
17.073
1.240
4.249
4.315
2.723
(3.022)
FIGURE 22-B
DETAIL V
SCALE 1 : 3
W
V
FIGURE 22-A
142
194
202
Concrete Crushers
TITLE:
Saw Blade Base
SIZE
B
DWG. NO.
3.2.1.4.2
REV
SCALE: 1:12
SHEET 10 OF 15
UNLESS OTHERWISE SPECIFIED:
DIMENSIONS ARE IN INCHES
APPROVALS
NAME
DATE
DRAWN
JKN
1-20-03
CHECKED
ENG APPR.
MFG APPR.
Q.A.
THIRD ANGLE PROJECTION
MATERIAL
A 36
FINISH
Mill Scale
DO NOT SCALE DRAWING
NEXT ASSY
USED ON
APPLICATION
PROPRIETARY AND CONFIDENTIAL
THE INFORMATION CONTAINED IN THIS DRAWING IS THE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.

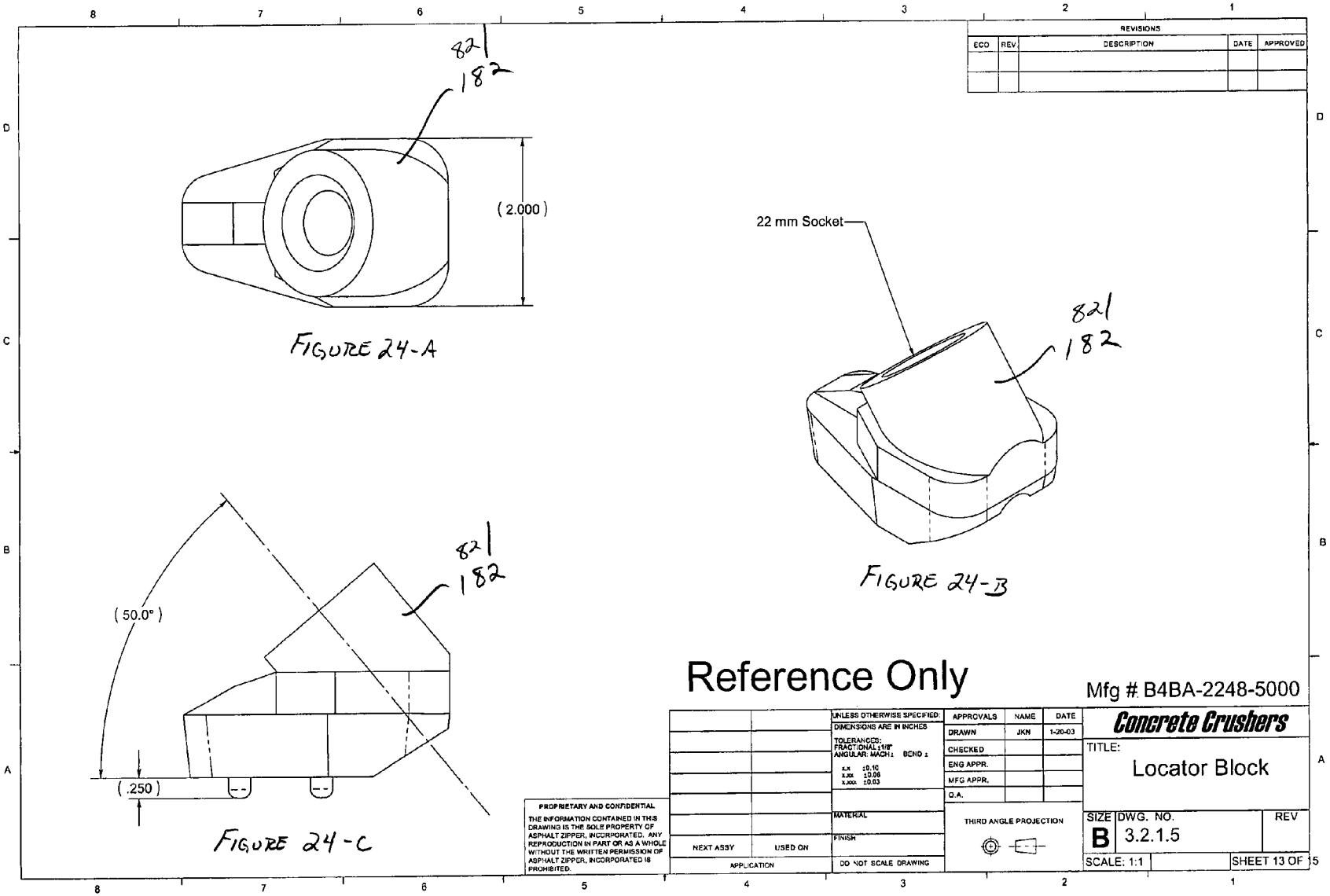
REVISIONS
ECO
REV
DESCRIPTION
DATE
APPROVED
821
182
22 mm Socket
FIGURE 24-B
Mfg # B4BA-2248-5000
Reference Only
Concrete Crushers
TITLE:
Locator Block
SIZE
B
DWG. NO.
3.2.1.5
REV
SCALE: 1:1
SHEET 13 OF 15
APPROVALS
NAME
DATE
DRAWN
JKN
1-20-03
CHECKED
ENG APPR.
MFG APPR.
Q.A.
THIRD ANGLE PROJECTION
UNLESS OTHERWISE SPECIFIED
DIMENSIONS ARE IN INCHES
MATERIAL
FINISH
DO NOT SCALE DRAWING
NEXT ASSY
USED ON
APPLICATION
PROPRIETARY AND CONFIDENTIAL
(2.000)
FIGURE 24-A
(50.0°)
(.250)
FIGURE 24-C

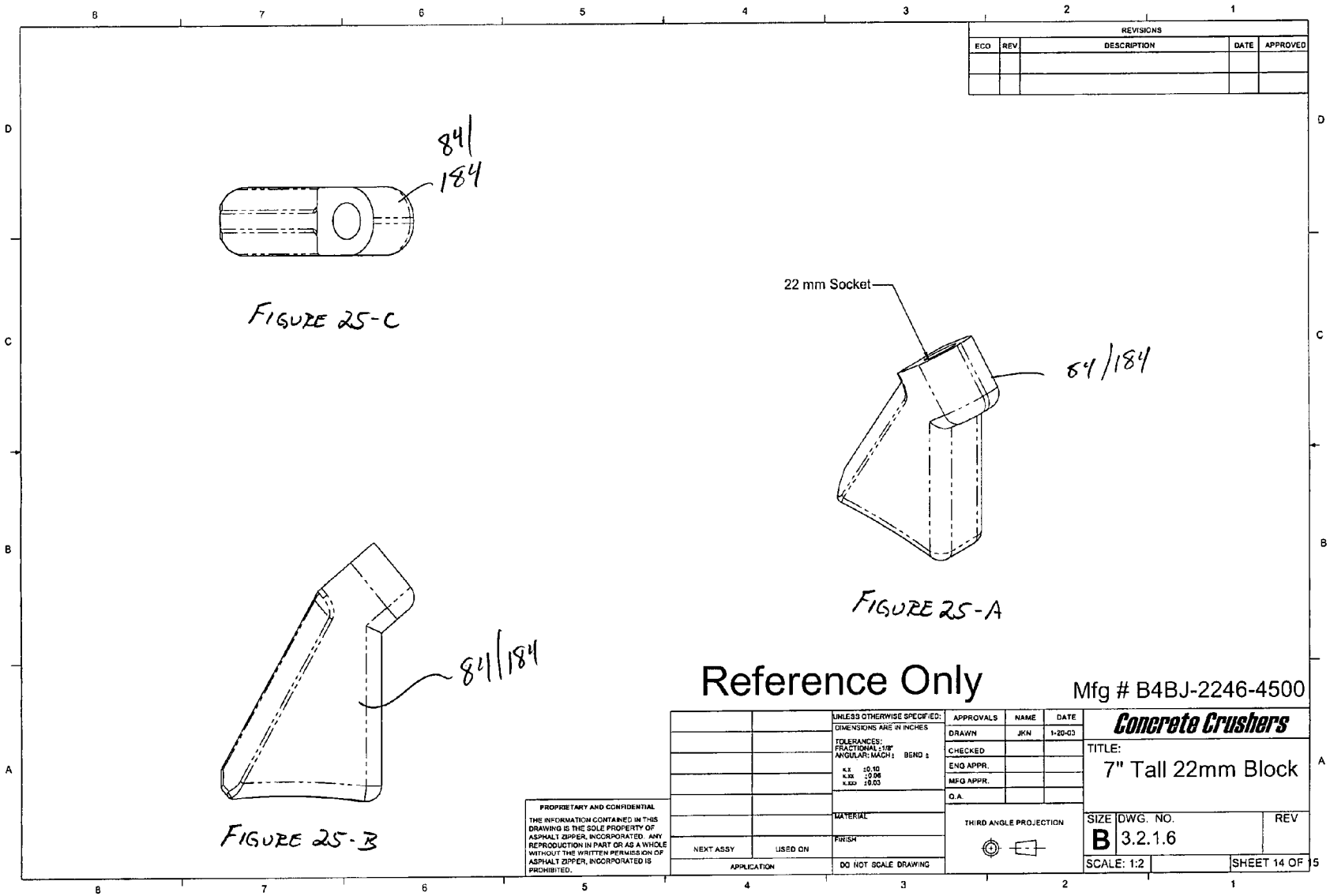
REVISIONS
ECO
REV
DESCRIPTION
DATE
APPROVED
84/184
22 mm Socket
FIGURE 25-A
Reference Only
Mfg # B4BJ-2246-4500
Concrete Crushers
APPROVALS
NAME
DATE
DRAWN
JKN
1-20-03
CHECKED
ENG APPR.
MFG APPR.
Q.A.
TITLE:
7" Tall 22mm Block
THIRD ANGLE PROJECTION
SIZE
DWG. NO.
REV
B
3.2.1.6
SCALE: 1:2
SHEET 14 OF 15
UNLESS OTHERWISE SPECIFIED:
DIMENSIONS ARE IN INCHES
TOLERANCES:
FRACTIONAL ±
ANGULAR: MACH ± BEND ±
X.X ±0.10
X.XX ±0.03
MATERIAL
FINISH
DO NOT SCALE DRAWING
NEXT ASSY
USED ON
APPLICATION
PROPRIETARY AND CONFIDENTIAL
THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.
84/184
FIGURE 25-C
84/184
FIGURE 25-B

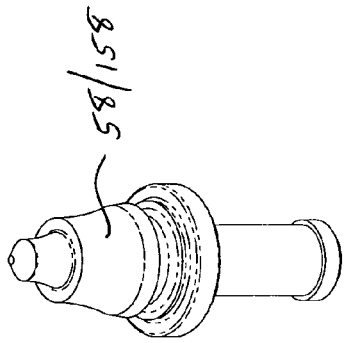

FIGURE 26-A

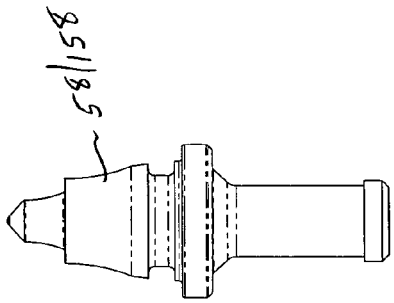

FIGURE 26-B

Reference Only

Mfg # K1MA-2251-6766

Concrete Crushers

TITLE: 22 mm Standard Bit

SIZE B | DWG. NO. 3.2.2 | REV

SCALE: 1:1 | SHEET 15 OF 15

| REVISIONS | | | |
|---|---|---|---|
| ECO | REV. | DESCRIPTION | DATE | APPROVED |

| APPROVALS | NAME | DATE |
|---|---|---|
| DRAWN | JKN | 1-20-02 |
| CHECKED | | |
| ENG APPR. | | |
| MFG APPR. | | |
| Q.A. | | |

UNLESS OTHERWISE SPECIFIED: DIMENSIONS ARE IN INCHES

TOLERANCES: FRACTIONAL ±1/8" ANGULAR ±1/2°4 BEND ± x.x ±0.06
x.xx ±0.03

MATERIAL

FINISH

DO NOT SCALE DRAWING

THIRD ANGLE PROJECTION

NEXT ASSY | USED ON

APPLICATION

PROPRIETARY AND CONFIDENTIAL

THE INFORMATION CONTAINED IN THIS DRAWING IS THE SOLE PROPERTY OF ASPHALT ZIPPER, INCORPORATED. ANY REPRODUCTION IN PART OR AS A WHOLE WITHOUT THE WRITTEN PERMISSION OF ASPHALT ZIPPER, INCORPORATED IS PROHIBITED.

REINFORCED CONCRETE MILLING/CUTTING MANDREL

PRIORITY

This application claims priority to U.S. provisional patent application no. 60/497,860, filed Aug. 26, 2003.

BACKGROUND

1. Field of the Invention

This invention relates to asphalt and concrete cutting heads or milling mandrels supported by and in use with various heavy machinery, and particularly to an asphalt and concrete milling mandrel specifically designed for cutting and pulverizing reinforced concrete.

2. Background of the Invention and Related Art

Asphalt milling is a technique currently employed to remove asphalt pavement for reconstruction or resurfacing, and for accessing buried utility lines. The technique involves the removal of asphalt pavement through the use of a cold planer, which can remove approximately ½ inch to 12 inches of pavement surface during a particular pass. A cold planer typically includes a barrel-like attachment, referred to as a milling mandrel or milling head, having a plurality of bits that are affixed to the exterior surface of the mandrel. The bits are exposed to the asphalt when the mandrel is in operation. Each bit has a hardened or carbide tipped end, a stem, and a flat end at the bottom of the stem. Bits are attached to mandrels by their insertion into channels or blocks, which are attached to the mandrels. The stem of the bit has a spring collet surrounding it. When the bit is forced into a channel in the bit block and pressed down through the shaft, the spring collet squeezes against the stem to tightly fit the stem within the channel. Between the stem and the bit's tipped end, there is an annular space on the bit that engages a lipped sector of the top end of the shaft and locks the bit into the shaft. This prevents the bit from leaving the shaft. Unfortunately, due to wear and tear, bits do not last long. Though they can last as long as several hours, oftentimes they need replacement after only fifteen minutes of mandrel operation. For instance, when an operator of a pavement grinder hits a manhole, many bits need replacement.

The cold planer could be coupled to a host vehicle (e.g., heavy machinery, such as a backhoe, a loader, or a skid-steer) or be self-propelled The mandrel rotates and is pushed into the pavement by the vehicle, causing the bits to engage and grind up the asphalt. Once ground, the asphalt can then be easily removed and replaced. The vehicle pushes the cold planer as the mandrel rotates to grind a trench in the asphalt pavement.

While the above milling device with its associated milling head are well suited to cut materials comprised of concrete and asphalt only, there are many instances when asphalt and concrete is reinforced using one or more reinforcement members, such as grid iron, rebar, etc. In these situations, the cutting or milling head is less equipped to efficiently cut or mill the reinforced material. Indeed, the situation where the asphalt milling or cutting device is required to mill and/or cut reinforced concrete or asphalt serves to exacerbate the problem discussed above.

Although bits on many milling heads are comprised of a hardened or carbide tip or end, any contact with various reinforcement members (typically comprised of steel or other metals) existing within the asphalt or concrete during operation of the milling device will damage and often destroy the bits as conventionally arranged and constructed. This is because the cutting or milling head is not intended to be used to cut through or to accommodate reinforcement members. As such, in the event of milling or cutting reinforced concrete or asphalt the bits existing on the mandrel must be changed much more frequently, thus making the project much more difficult to finish, as well as significantly increasing the costs of operation and the project.

SUMMARY AND OBJECTS OF THE INVENTION

As discussed above, prior art milling heads comprise many deficiencies and create several problems when required to mill or cut reinforced asphalt or concrete.

Therefore, it is an object of some embodiments of the present invention to provide a milling head that is capable of effectively cutting reinforced concrete and asphalt.

It is another object of some embodiments of the present invention to provide a milling head comprising at least one distinct cutting and/or sawing sector for cutting reinforced members, combined with a milling sector having chunking or milling teeth for milling the asphalt or concrete comprising the reinforced members.

In accordance with the invention as embodied and broadly described herein, the present invention features a milling mandrel attachable to a milling device and comprising a primary cylindrical barrel; a plurality of cutting bits removably attached to the primary barrel and arranged about a support base within a cutting/sawing area or segment or sector defined on the primary barrel, wherein the cutting bits are arranged in a pre-determined bit pattern via a bit location system and patterned cutting bit system; and a plurality of chunking or milling bits also removably attached to the primary barrel and arranged within a chunking or milling area or segment or sector also defined on the primary barrel and adjacent and operable with each of the cutting or sawing sectors.

The present invention further features a method of cutting and/or milling reinforced concrete or asphalt.

BRIEF DESCRIPTION OF THE DRAWINGS

In order that the manner in which the above recited and other advantages and features of the invention are obtained, a more particular description of the invention briefly described above will be rendered by reference to specific embodiments thereof, which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIG. 2A illustrates a front view of a support base according to one exemplary embodiment of the present invention;

FIG. 2B illustrates a cross-sectional view of a support base according to one exemplary embodiment of the present invention;

FIG. 3A illustrates a front view of a support base according to another exemplary embodiment of the present invention;

FIG. 3B illustrates a cross-sectional view of the support base in FIG. 3A;

FIG. 3C illustrates a detailed cross-sectional view of the support base in FIG. 3A;

FIG. 8 illustrates a side view of one exemplary cutting sector comprising an exemplary cutting bit pattern thereon according to one exemplary bit location assembly;

FIGS. 10A–10C illustrate various detailed views of the right wedge or wedge member utilized in the bit location assembly to orient and locate the plurality of cutting bits in an angled right facing or right orienting manner;

FIGS. 11A–11C illustrate various detailed views of the left wedge or wedge member utilized in the bit location assembly to orient and locate the plurality of cutting bits in an angled left facing or left orienting manner;

FIGS. 12A–12C illustrate various detailed views of the right wedge or wedge member utilized in the bit location assembly to orient and locate the plurality of cutting bits in an upright manner;

FIG. 17A illustrates a side view of one cutting sector of the milling mandrel of FIG. 16;

FIG. 17B illustrates a cross-sectional view of the milling mandrel of FIG. 16;

FIG. 18A illustrates a perspective view of a support base comprising a plurality of patterned cuts thereon according to a patterned bit assembly designed to receive, accept, secure, and orient a plurality of cutting bits;

FIG. 18B illustrates a front view of the support base of FIG. 18A;

FIG. 18C illustrates a side view of the support base of FIG. 18B;

FIG. 18D illustrates a detailed cross-sectional view of the support base of FIG. 18A;

FIG. 19A illustrates a side view of a support base comprising a plurality of patterned cuts thereon according to a patterned bit assembly designed to receive, accept, secure, and orient a plurality of cutting bits;

FIG. 19B illustrates a detailed side view of a section of the support base of FIG. 19A highlighting the left facing cut;

FIG. 19C illustrates a detailed cross-sectional view of a section of the support base of FIG. 19A highlighting the left facing cut;

FIG. 19D illustrates a perspective view of the support base of FIG. 19A;

FIG. 19E illustrates a detailed view of a section of the support base of FIG. 19D highlighting the left facing cut;

FIGS. 20A–20E illustrate the left facing cut shown in FIGS. 19A–19E repeated;

FIG. 21A illustrates a side view of a support base comprising a plurality of patterned cuts thereon according to a patterned bit assembly designed to receive, accept, secure, and orient a plurality of cutting bits;

FIG. 21B illustrates a detailed side view of a section of the support base of FIG. 21A highlighting the center cut;

FIG. 21C illustrates a detailed cross-sectional view of a section of the support base of FIG. 21A highlighting the center cut;

FIG. 21D illustrates a top view of the support base of FIG. 21A;

FIG. 21E illustrates a detailed view of a section of the support base of FIG. 21D highlighting the center cut;

FIG. 22A illustrates a side view of a support base comprising a plurality of patterned cuts thereon according to a patterned bit assembly designed to receive, accept, secure, and orient a plurality of cutting bits;

FIG. 22B illustrates a detailed side view of a section of the support base of FIG. 22A highlighting the right facing cut;

FIG. 22C illustrates a detailed cross-sectional view of a section of the support base of FIG. 22A highlighting the right facing cut;

FIG. 22D illustrates a perspective view of the support base of FIG. 22A;

FIG. 22E illustrates a detailed view of a section of the support base of FIG. 22D highlighting the right facing cut;

FIGS. 24A–24C illustrate different views a cutting bit casing according to one exemplary embodiment of the present invention;

FIGS. 25A–25C illustrate different views of a milling bit casing according to one exemplary embodiment of the present invention;

FIGS. 26A and 26B illustrate one exemplary cutting bit;

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 28, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

Figure 1:
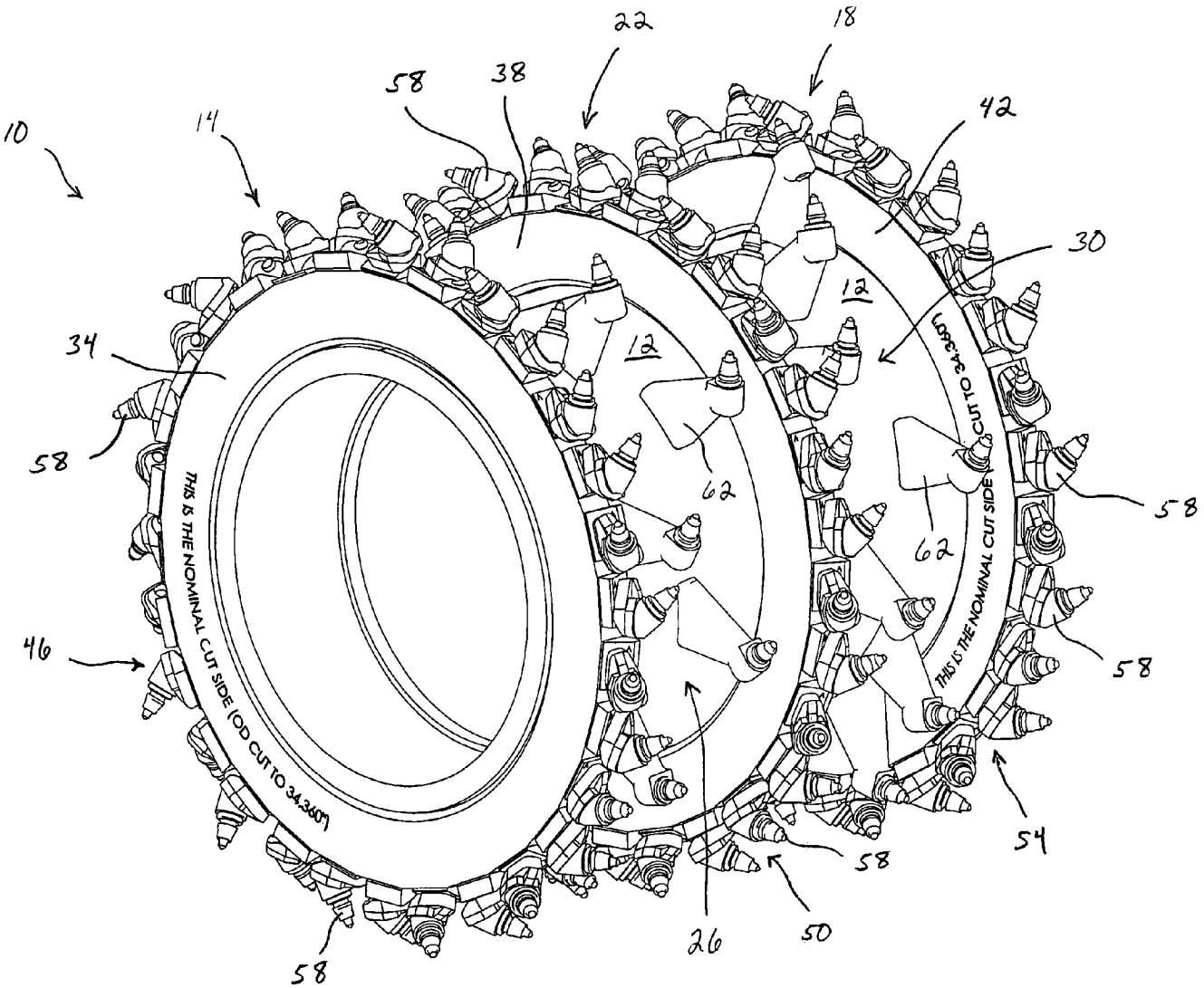
FIG. 1 illustrates a perspective view of one exemplary embodiment of the present invention milling mandrel.

With reference to FIG. 1, the present invention describes a method and system for cutting and/or milling concrete, asphalt, and/or any other similar surfaces (hereinafter referred to collectively as paving material), and particularly such surfaces comprising some type of reinforcement member therein, such as rebar or grid iron. The method utilizes and the system comprises a milling mandrel or cutting head 10 having a primary cylindrical barrel 12, wherein milling mandrel 10 is attachable to a milling device (not shown) that couples to a vehicle (not shown) used to propel the milling device or a self-propelled milling device. Milling mandrel 10 comprises a plurality of cutting bits 58 removably attached to primary barrel 12 via support bases 34, 38, and 42, respectively, arranged within one or more cutting/sawing sectors, shown as first cutting sector 14, second cutting sector 18, and divisional cutting sector 22, each defined on primary barrel 12. Milling mandrel 10 also comprises a plurality of chunking or milling bits 62 removably attached to primary barrel 12 and arranged within one or more chunking or milling sectors, shown as milling sectors 26 and 30, which are also defined on primary barrel 12. Each milling sector is adjacent to and operable with a cutting sector.

Milling mandrel 10 must apply a design and bit pattern that will not only cut through and mill paving material, but that will also cut through any reinforced material contained within the paving material while still allowing the milling device to maintain a respective and relative amount of efficiency. In the preferred, yet exemplary, embodiment that is shown and discussed below, milling mandrel 10 comprises two primary functions: a cutting function and a milling function.

As discussed, the cutting function is performed by at least one, and preferably multiple, cutting sectors 14, 18, and 22, each comprising a plurality of cutting bits 58 arranged about support bases 34, 38, and 42, respectively, within each cutting sector. In a preferred embodiment, first and second cutting sectors 14 and 18 are located or positioned opposite one another at each edge of the cylindrical milling mandrel 10. At least one divisional cutting sector 22 is also included that divides milling mandrel 10, and particularly primary barrel 12, so as to comprise multiple, in this case two, separate milling sectors, shown as milling sectors 26 and 30. At least one divisional cutting sector 22 is preferably centrally located between first and second cutting sectors 14 and 18 to create or define two equidistant milling sectors. Additional divisional cutting sectors are also contemplated that may be placed at various positions along the primary barrel to create multiple milling sectors, each comprising a plurality of milling bits.

Cutting sectors 14, 18, and 22 each comprise means for cutting reinforced paving material. In one exemplary embodiment, means for cutting reinforced paving material comprises cutting sectors 14, 18, and 22. Cutting sectors 14, 18, and 22 each comprise a support base, shown as support bases 34, 38, and 42, respectively, that extend upward a pre-determined distance from primary cylindrical barrel 12 in a perpendicular or angled manner. Cutting sectors 14, 18, and 22 further comprise a bit location system resulting in patterned bit assemblies, shown as patterned bit assemblies 46, 50, and 54, respectively. Cutting sectors 14, 18, and 22 each comprise a plurality of cutting bits 58 that are strategically positioned and arranged annularly about each respective support base according to the design of the bit location system and the associated patterned bit assembly, and that functions to saw or cut through any reinforced material existing within the paving material so that the overall paving material may be cut and milled as desired. Each of cutting bits 58, or rather the pattern of cutting bits 58, are/is established in accordance with a bit location system. In a preferred arrangement, each cutting sector on the milling mandrel has one bit every 0.5 inches of cutting width over the span of the milling mandrel.

The cutting sectors of the present invention are an improvement over prior art designs in that they reduce the longest possible piece of reinforcement material that can move through the cutter cavity, preferably to around 10 to 15 inches, unlike prior art cutting systems wherein the longest pieces are anywhere between 30 and 35 inches. Providing a divisional cutting sector 22 allows milling mandrel 10 of the present invention to mill greater widths of reinforced paving material at one time than can be done with prior art devices. Once the reinforced members in the paving material are cut, milling device 10 functions as normal to mill the remaining paving material via the milling function.

The milling function is performed by at least one, and preferably multiple, milling sectors, shown as milling sectors 30 and 34, each also comprising a plurality of milling bits 62 arranged within the milling sectors. In a preferred embodiment, milling sectors 30 and 34 are preferably located or positioned between cutting sectors 14 and 18, separated by divisional cutting sector 22. Or, stated differently, milling sectors 30 and 34 are comprised of the area existing on either side of divisional cutting sector 22 existing between cutting sectors 14 and 18 of milling mandrel 10, such that there are two milling sectors present on milling mandrel 10.

The improved cutting ability of milling mandrel 10 and the reduction in size of the cut reinforcement material is made possible by either one of or a combination of the location and design of the advanced cutting sectors, the bit location system, the patterned bit assemblies, the addition of divisional cutting sector 22 that effectively divides the milling mandrel into two sections, and preferably two equal sections, and/or the overall design of milling mandrel 10. Each of these concepts is discussed in more detail below.

FIG. 2 illustrates primary barrel 12, and particularly first support base 34, as it comprises its unique design and respective portion of the patterned bit assembly of the bit location system of milling mandrel 10, according to one exemplary embodiment. Specifically, FIG. 2A illustrates first support base 34 as comprising a plurality of flats 70 annularly spaced around the perimeter of support base 34. Each of flats 70 comprise an identified or predetermined length capable of receiving one or more bit casings or locator blocks (not shown) thereon. Each of flats 70 comprise an equal length around the perimeter of support base 34. However, support base 34 may also comprise flats of differing or varying lengths, as well as flats that are tangential or off-set from support base 34. FIG. 2A illustrates flats 70 as being positioned in a tangential manner with respect to support base 34. Unlike prior art cutting devices or systems, flats 70 provide a planar surface upon which one or more bits or bit assemblies may reside or be coupled to. As shown, support base 34 essentially comprises a multiple-sided polygon with equal length flats that aid in bit placement and bit positioning about primary barrel 12 and milling mandrel 10.

FIG. 2B illustrates support base 34 as taken along lines B—B of FIG. 2A. Specifically, FIG. 2B illustrates support base 34 as comprising an extended height that extends above and from the surface of primary barrel 12. The height of support base 34 may vary but is preferably a substantial distance above the surface of primary barrel 12 so as to allow the bits positioned atop of support base 34 to contact the paving material first, and to allow the cutting sectors of milling mandrel 10 to penetrate into paving material a substantial distance prior to contact of any milling bits located or positioned within any one of the milling sectors existing on milling mandrel 10. Moreover, equipping milling mandrel 10 with an elevated support base 34 that has cutting bits positioned atop thereof further allows milling mandrel 10, and particularly each of the cutting sectors existing thereon, to first contact any reinforcement members existing within the paving material so that they may be cut in preparation for further milling and removal by the milling device.

FIGS. 3A, 3B, and 3C each illustrate an alternative embodiment of a support base 34 in which support base 34 is not integrally formed with primary barrel 12, but is instead a separate and independent piece that is fixed or attached to primary barrel 12. In the embodiment shown in FIGS. 3A through 3C, support base 34 is welded to primary barrel 12 and secured in place via opposing chamfers formed or existing on both sides that meet with and fit within complimentary chamfers formed or existing within primary barrel 12. The embodiment shown in FIGS. 3A through 3C further allows primary barrel 12 and milling mandrel 10 to comprise an elevated support base 34, which subsequently provides an elevated cutting sector that functions similarly to the embodiment shown in FIGS. 2A and 2B.

Figure 4:
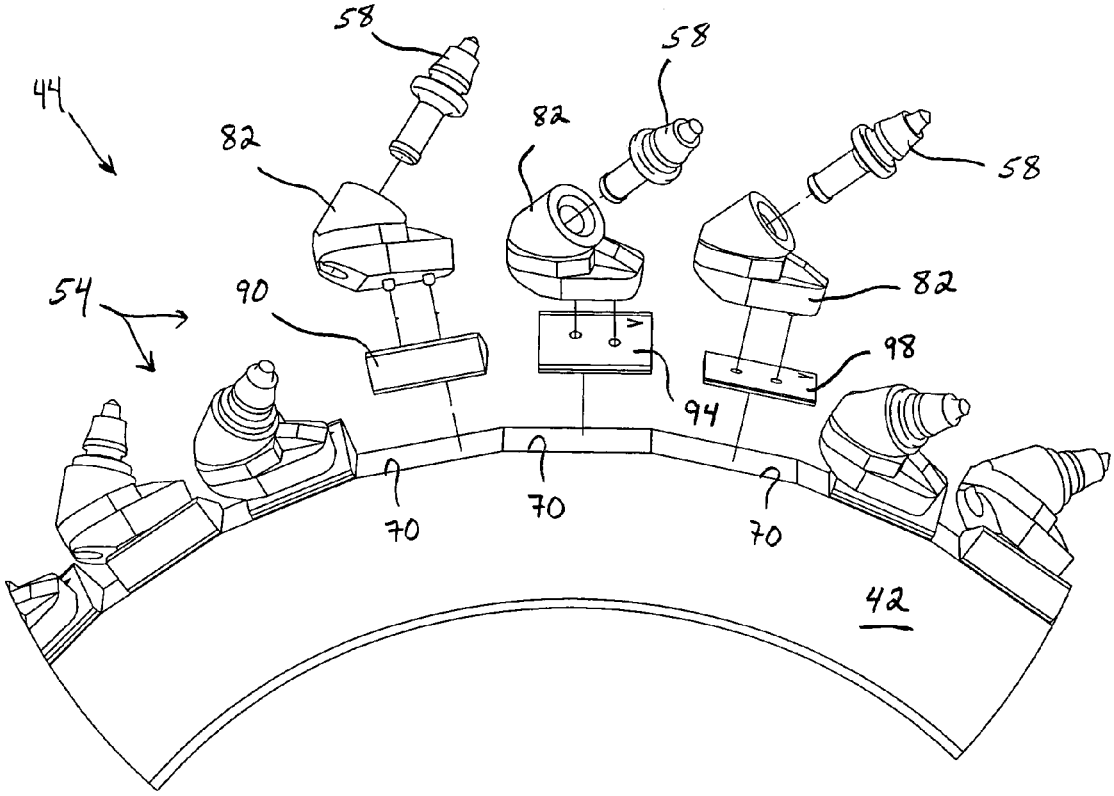
FIG. 4 illustrates a detailed cut-away side view of a support base and the bit locating and patterned bit assemblies according to one exemplary embodiment of the present invention.

FIG. 4 illustrates how the plurality of bits are arranged and coupled to a support base 42. More specifically, FIG. 4 illustrates one exemplary embodiment of a bit locating assembly 44 having an exemplary patterned cutting bit assembly 54 thereon. As shown, bit locating assembly 44 is comprised of various shaped wedges, shown as left wedge 90, right wedge 94, and center wedge 98, that couple or are fixed to each of flats 70 positioned annularly about support base 42. Each of wedges 90, 94, and 98 function to dictate and define the respective orientation of the cutting bits attached thereto. To attach cutting bits 58, cutting bits 58 are secured within block locators or bit casings 82. Bit casings 82 are subsequently mounted to support base 42 via their respective wedged members. For example, FIG. 4 shows cutting bit 58 as it attaches to bit casing 82 which subsequently attaches to left wedge 90 that is securely fashioned and coupled to flat 70 of support base 42. Subsequent cutting bits 58 are attached to support base 42 in a similar manner via right wedge 94, and center wedge 98. Although obvious, it should be noted that left wedge 90 functions to orient bit casing 82 as well as cutting bit 58 in a left oriented or left pointing or left angled or left facing position or manner if milling mandrel 10 is viewed from the top. Similarly, right wedge 94 orients bit casing 82 and cutting bit 58 in an opposing right oriented or right pointing or right angled or right facing position or manner with respect to milling mandrel 10 which is also viewed from the top. Finally, central wedge 98 functions to orient bit casing 82 and cutting 58 in a substantially vertical or upright or perpendicular manner with respect to milling mandrel 10, also viewed from the top.

As FIG. 4 illustrates, left wedge 90, right wedge 94, and center wedge 98 are used multiple times to create patterned cutting bit assembly 54 as arranged about support base 42. The particular pattern of patterned cutting bit assembly 54 may vary, with each of left wedge 90, right wedge 94, and center wedge 98 being utilized in any number, combination, or frequency as desired to come up with a particular cutting bit pattern. Two exemplary cutting bit patterns are provided and explained below.

Figure 5:
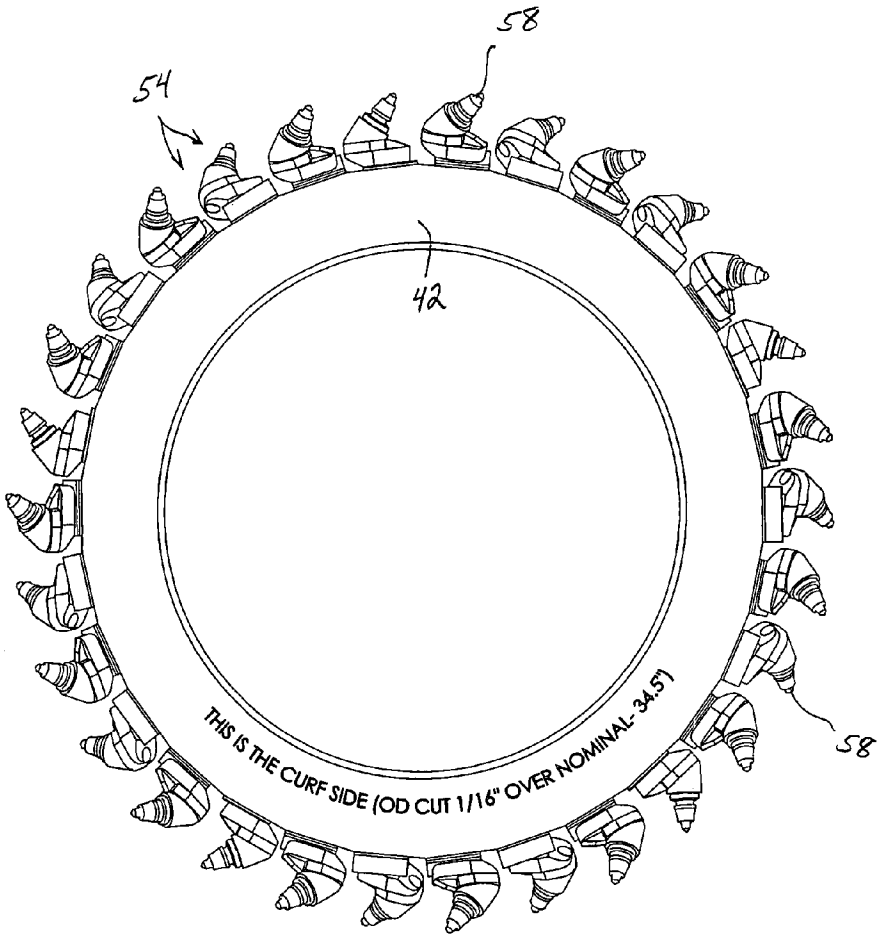
FIG. 5 illustrates a side view of a cutting sector having a plurality of bits patterned thereon according to one exemplary bit location assembly.
Figure 6:
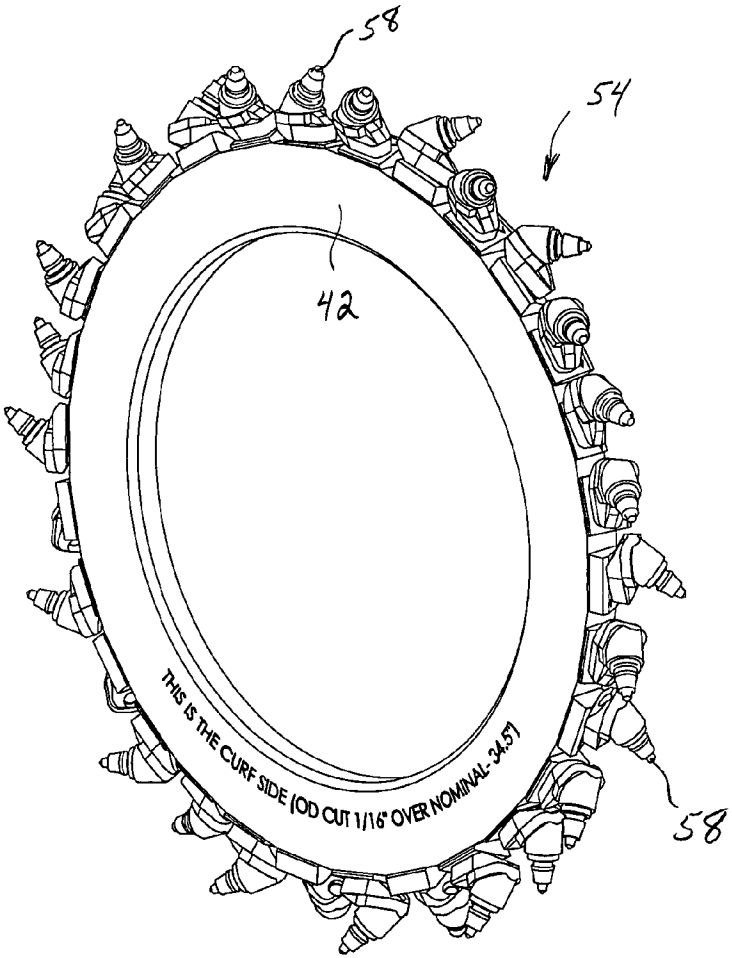
FIG. 6 illustrates a perspective view of the support base in FIG. 5.
Figure 7:
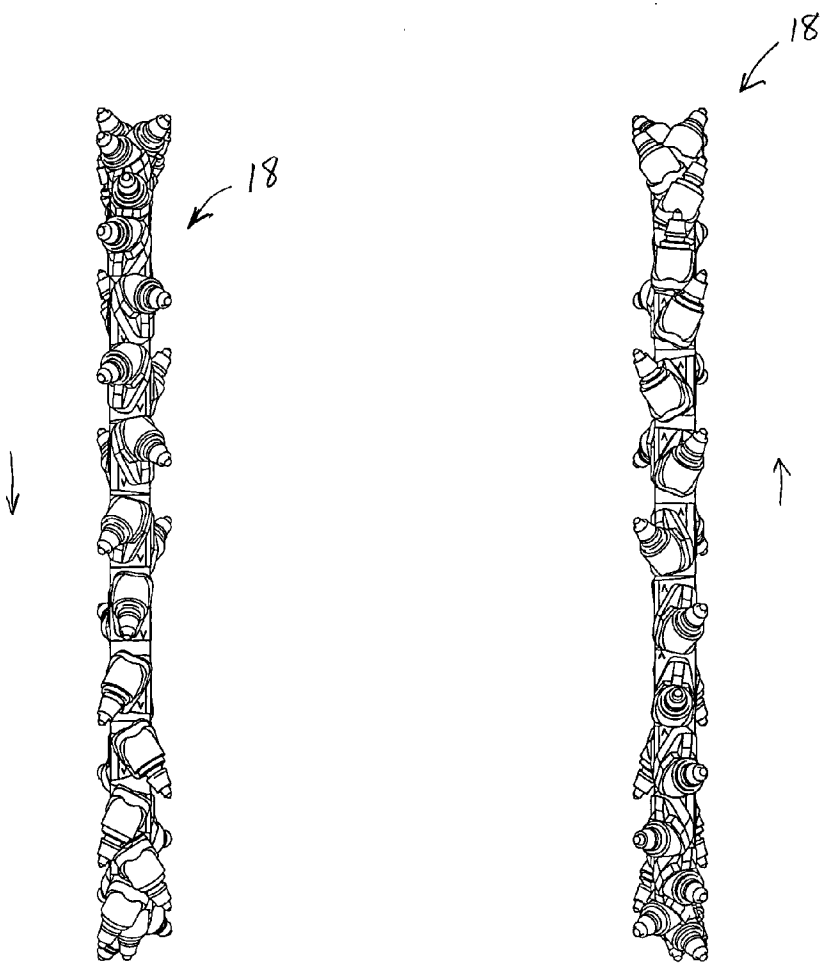
FIG. 7 illustrates two side views of a cutting sector facing in opposing directions, wherein the cutting sector has a plurality of bits patterned thereon according to one exemplary bit location assembly.

FIGS. 5, 6, and 7 illustrate a support base 42 as comprising a particular patterned cutting bit assembly 54 arranged annularly thereon so that each of bits 58 are oriented and positioned in a specific predetermined and particular manner. As will be evident to one ordinarily skilled in the art, the number of cutting bits, the size of the cutting bits, the cutting bit arrangement or pattern, and the number of respective cutting sectors may all vary according to the concepts described herein. The number, pattern, and orientation of the bits will largely be dependant upon the particular job or task for which the milling mandrel is intended, as well as the composition of the paving material, including any reinforcement members, that is to be cut and/or milled.

FIG. 8 illustrates one exemplary cutting bit pattern for patterned cutting bit assembly 54 arranged about a support base 42. Specifically, patterned cutting bit assembly 54 comprises a pattern of left, right, and center wedges repeated in a specific manner about or around support base 42. As shown, the pattern of wedges is as follows: right wedge 94, center wedge 98, right wedge 94, left wedge 90, right wedge 94, and left wedge 90 repeated about support base 42 filling each of the flats 70 located thereon.

Figure 9:
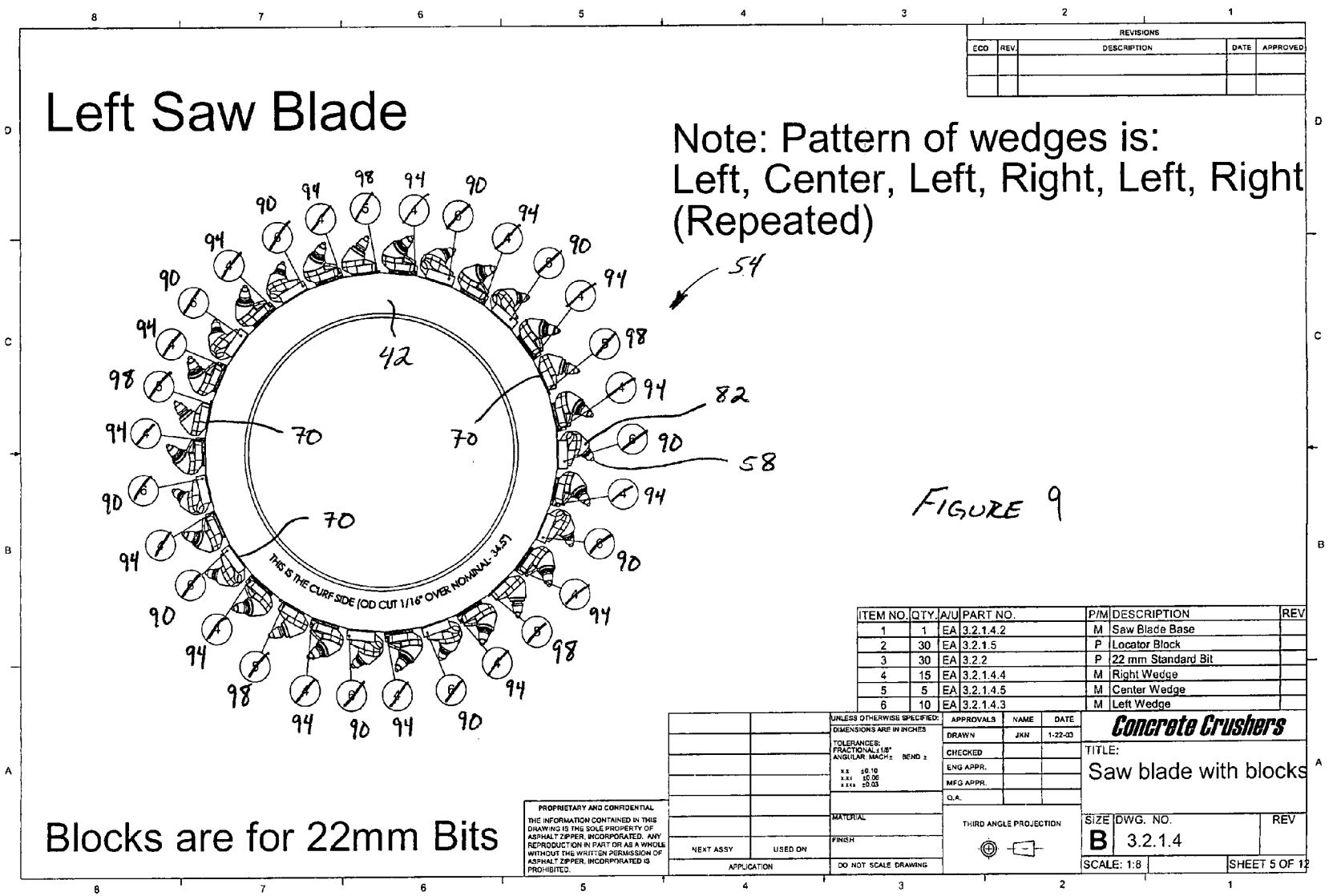
FIG. 9 illustrates a side view of another exemplary cutting sector comprising a different cutting bit pattern thereon according to the bit location assembly of FIG. 8.

FIG. 9 illustrates yet another exemplary embodiment of a patterned cutting bit assembly 54 arranged about a support base 42. As shown, the pattern of wedges is as follows: left wedge 90, center wedge 98, left wedge 90, right wedge 94, left wedge 90, and right wedge 94 repeated about support base 42 filling each of flats 70 existing thereon.

FIGS. 10A, 10B, and 10C illustrate the detailed embodiment of right wedge 94. As shown in FIG. 10A, right wedge 94 comprises a bit receiving surface 100 capable of receiving or accepting a bit casing (not shown) thereon. FIG. 10B illustrates how bit receiving surface 100 is formed at a substantial angle θ with respect to attachment surface 101 that attaches and couples to a support base (not shown). The particular angle θ of right wedge 94 may vary as needed depending on the particular cutting characteristics required for the job. Right wedge 94 further comprises one or more apertures 102 formed therethrough that are capable of receiving an attachment means, such as a screw, nail, bolt, etc., used to securely couple or attach a bit casing to bit receiving surface 100 of right wedge 94. Optionally, right wedge 94 may also comprise an orientation marker 106 that may be used to identify and/or signal a secured bit orientation.

FIGS. 11A, 11B, and 11C illustrate left wedge 90. The components and functions of left wedge 90 are similar to the components and functions of right wedge 94 as illustrated in FIGS. 10A through 10C, and explained above.

FIGS. 12A, 12B, and 12C illustrate the center wedge 98. Each of the components and functions of center wedge 98 are similar to the components and functions of either of left or right wedges 90 and 94, respectively, illustrated in FIGS. 10A through 10C, or 11A through 11C, and explained above. The primary difference between each of left wedge 90, right wedge 94, and center wedge 98 lies in the particular orientation created for any bit attached thereto as each wedge is subsequently attached to flats 70 on a support base. As stated above, left wedge 90 orients a cutting bit in a left directional outward manner opposite that of right wedge 94. In addition, center wedge 98 orients a bit in a perpendicular or substantially perpendicular manner with respect to a support base.

One significant advantage of the patterned cutting bit assembly is that the cutting bits are able to be exactly lined up in any orientation and maintained in that pattern or arrangement. Using the wedges in different patterns allows the milling mandrel to comprise any type of cutting sequence needed. In addition, the patterned bit assembly, as the cutting bits exist in a scattered arrangement, is able to cut out concrete and any reinforcing material in a more effective and efficient manner than prior art designs.

Figure 13:
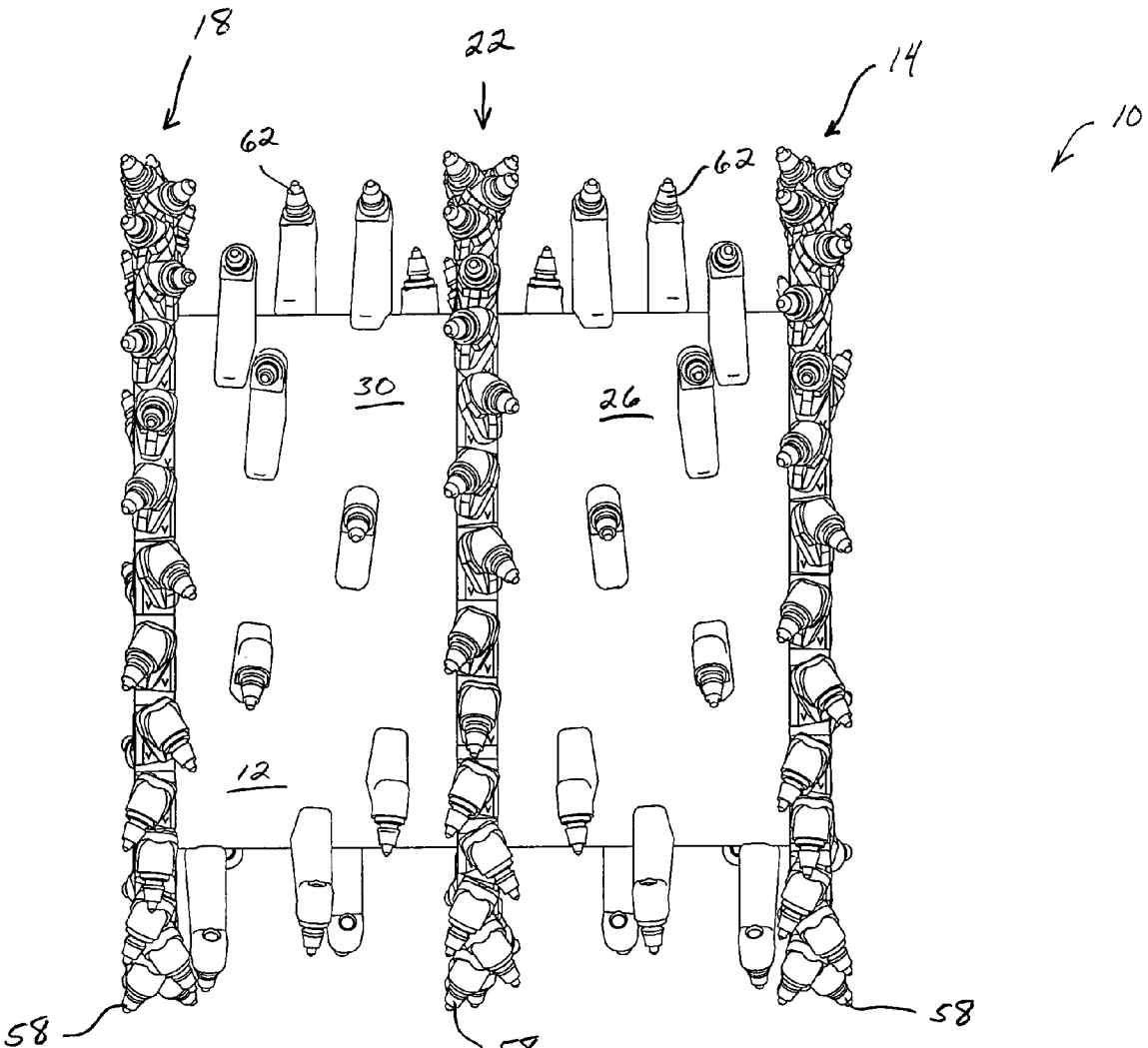
FIG. 13 illustrates a front view of an exemplary milling mandrel comprising the unique cutting sectors as related to the milling sectors, as well as the cutting bit location assembly of the present invention.
Figure 14:
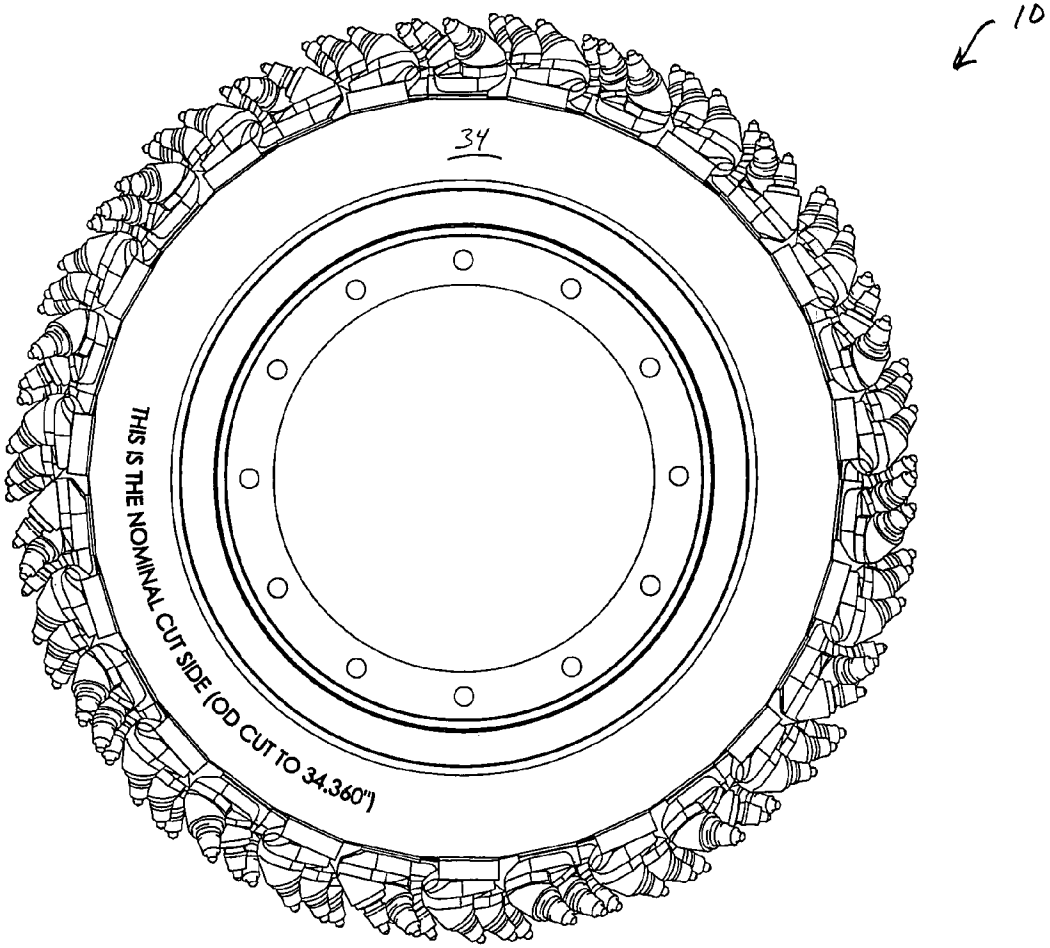
FIG. 14 illustrates a side view of the milling mandrel of FIG. 13.

FIGS. 13 and 14 illustrate one exemplary embodiment of milling mandrel 10 comprising a primary barrel 12 having a first cutting sector 14, a second cutting sector 18, and a divisional cutting sector 22 formed therein. Each of cutting sectors 14, 18, and 22 comprise a specific patterned cutting bit assembly specifically designed for the task at hand. The pattern may be the same, or different for each sector. In addition, as shown, each of cutting sectors 14, 18, and 22 exist in an elevated manner above the surface of primary barrel 12 such that each of these cutting sectors contact the paving materials and any reinforcement members existing therein prior to the milling bits 62 that are positioned within first and second milling sectors 26 and 30. In this arrangement, cutting sectors 14, 18, and 22 allow milling mandrel 10 to essentially function as a saw wherein each of the cutting sectors saws through the paving material and any reinforcement members existing therein to sever or cut the reinforcement members such that the remainder of the paving materials may be milled and removed in a more efficient and effective manner. All of support bases 34, 38, and 42 are intended to comprise a similar design. However, it is also contemplated that a milling mandrel may comprise support bases of differing heights in addition to differing cutting bit patterns or arrangements.

FIG. 13 illustrates divisional cutting sector 22 as dividing the milling sectors of milling mandrel 10 into two sectors, namely milling sector 26 and milling sector 30. Divisional cutting sector 22 with its patterned cutting bit assembly functions to sever or cut any reinforcement members existing within the paving material in two smaller segments than would otherwise be possible with the provision of just the outer cutter sectors 14 and 18. This provides a significant advantage over prior art milling mandrels in that the reinforcement members are cut into smaller segments and are more easily removed, thus allowing paving material to be milled and removed at a quicker pace.

Figure 15:
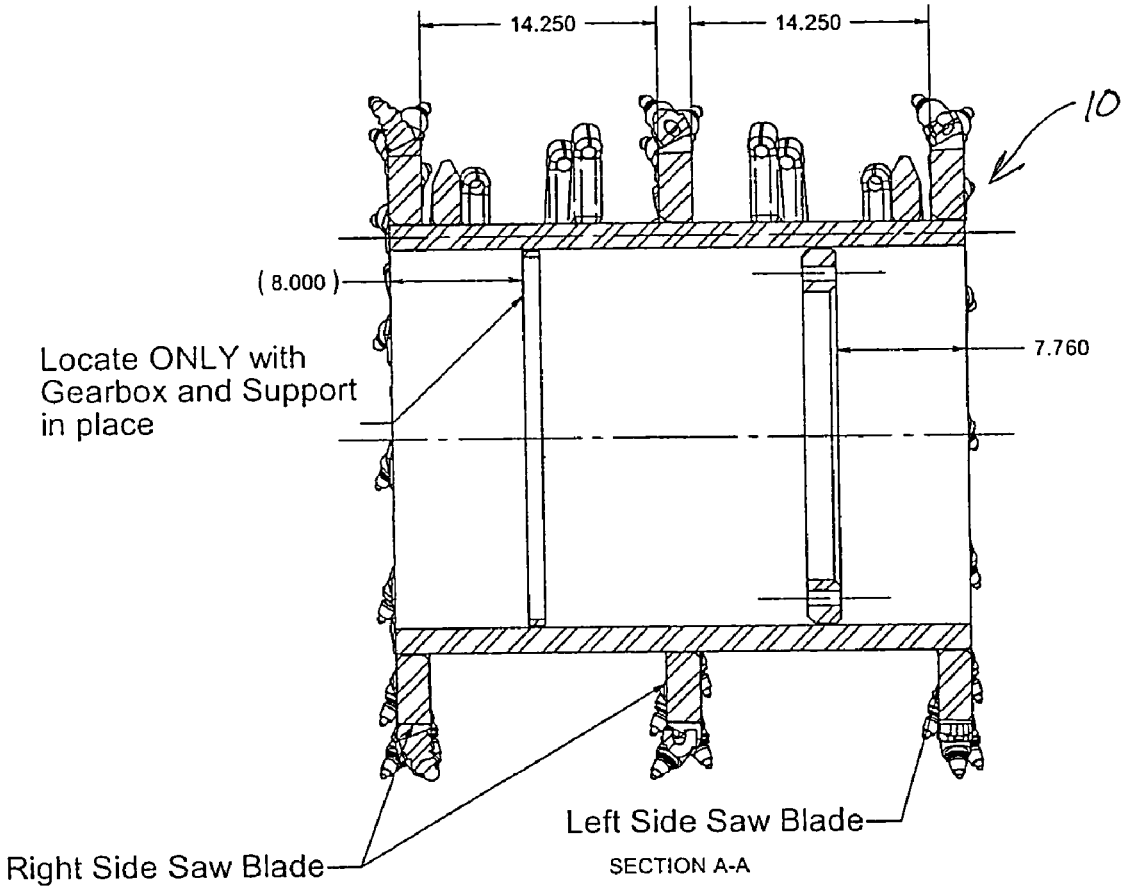
FIG. 15 illustrates a cut away front view of the milling mandrel according to one embodiment of the present invention.

FIGS. 14 and 15 illustrate a side view and a cut-away front view, respectively, of milling mandrel 10, according to one exemplary embodiment of the present invention.

Figure 16:
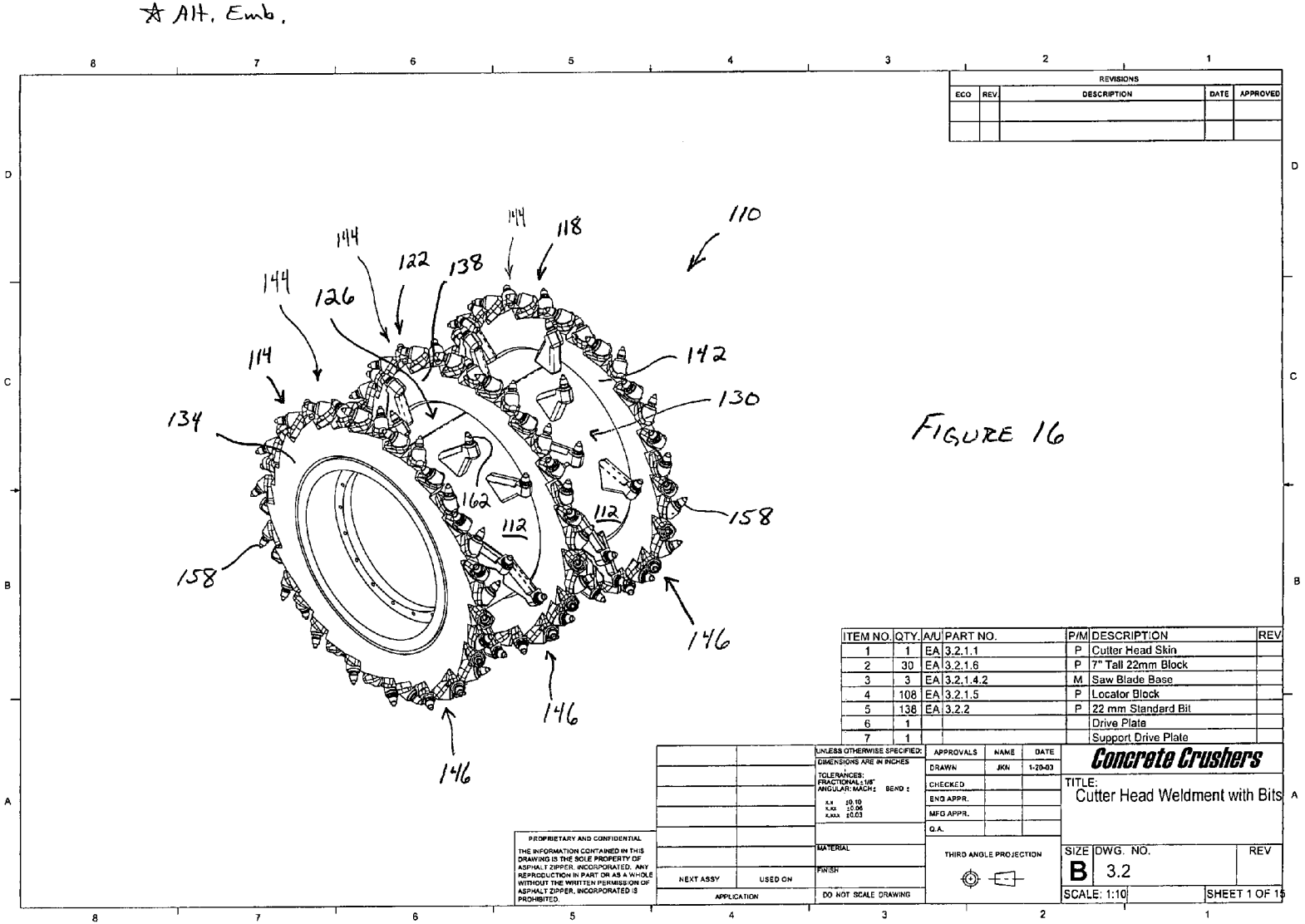
FIG. 16 illustrates a perspective view of another exemplary milling mandrel comprising another exemplary bit location assembly.

FIG. 16 and FIGS. 17-A and 17-B illustrate another alternative embodiment of a milling mandrel 110 having strategically positioned thereon, and particularly on primary barrel 12, one or more cutting sectors, shown as first and second cutting sectors 114 and 118, and divisional cutting sector 122, as well as milling sectors 126 and 130 having milling bits 162 securely positioned therein. Similar to the embodiment discussed above, each cutting sector further comprises a bit locating assembly 144 comprising a support base (shown as support bases 134, 138, and 142) and a patterned cutting bit assembly 146 for providing an optimal device and pattern of cutting bits 158 for cutting reinforced material existing within paving material. However, unlike the embodiment described above in which the support bases preferably comprise equally spaced flats formed within the support base that are capable of receiving a bit and bit casing, each of support bases 134, 138, and 142 shown in FIGS. 16, 17-A, and 17-B comprise cut sections of flat, angled, and/or offset design for the purpose of locating the bits that are subsequently attached thereto. This is a significant improvement over the tipping and welding process used in prior art designs.

As shown in FIGS. 18A–18D, support base 142 is shown comprising three cuts of different orientations arranged in one exemplary bit pattern for varying bit positioning or location (similar to the orientations and bit patterns described above). Cut 190 comprises a left angled or facing cut, cut 194 comprises a right angled or facing cut, and cut 198 comprises a center or flat or level cut. These cut orientations function to orient their supported bits in an associated position and function to provide any pre-determined patterned cutting bit assembly and associated bit pattern desired. Essentially, the function of each cut formed in each support base on the milling mandrel is similar to the wedges described above. As such, the particulars of these cuts are not specifically recited herein.

The exemplary bit pattern achieved and illustrated in FIG. 18-C comprises left cut 190, center cut 198, left cut 190, right cut 194, left cut 190, and center cut 198 repeated annularly about support base 142. As mentioned, any bit pattern desired is made possible. Moreover, each of cuts 190, 194, and 198 may comprise any angle, and each cutting sector and support base may comprise any patterned bit assembly to provide an optimal bit location assembly for the milling mandrel.

FIGS. 18A and 18B further illustrate apertures 202 formed in each of cuts 190, 194, and 198 that are used to define and set the tip angle for each bit and bit casing attached to the various cuts.

FIGS. 19A–19E and 20A–20E illustrate several different detailed views of left pattern or cut 190.

FIGS. 21A–21E illustrate several different detailed views of center cut 198.

FIGS. 22A–22B illustrate several different detailed views of right pattern or cut 194.

Figure 23:
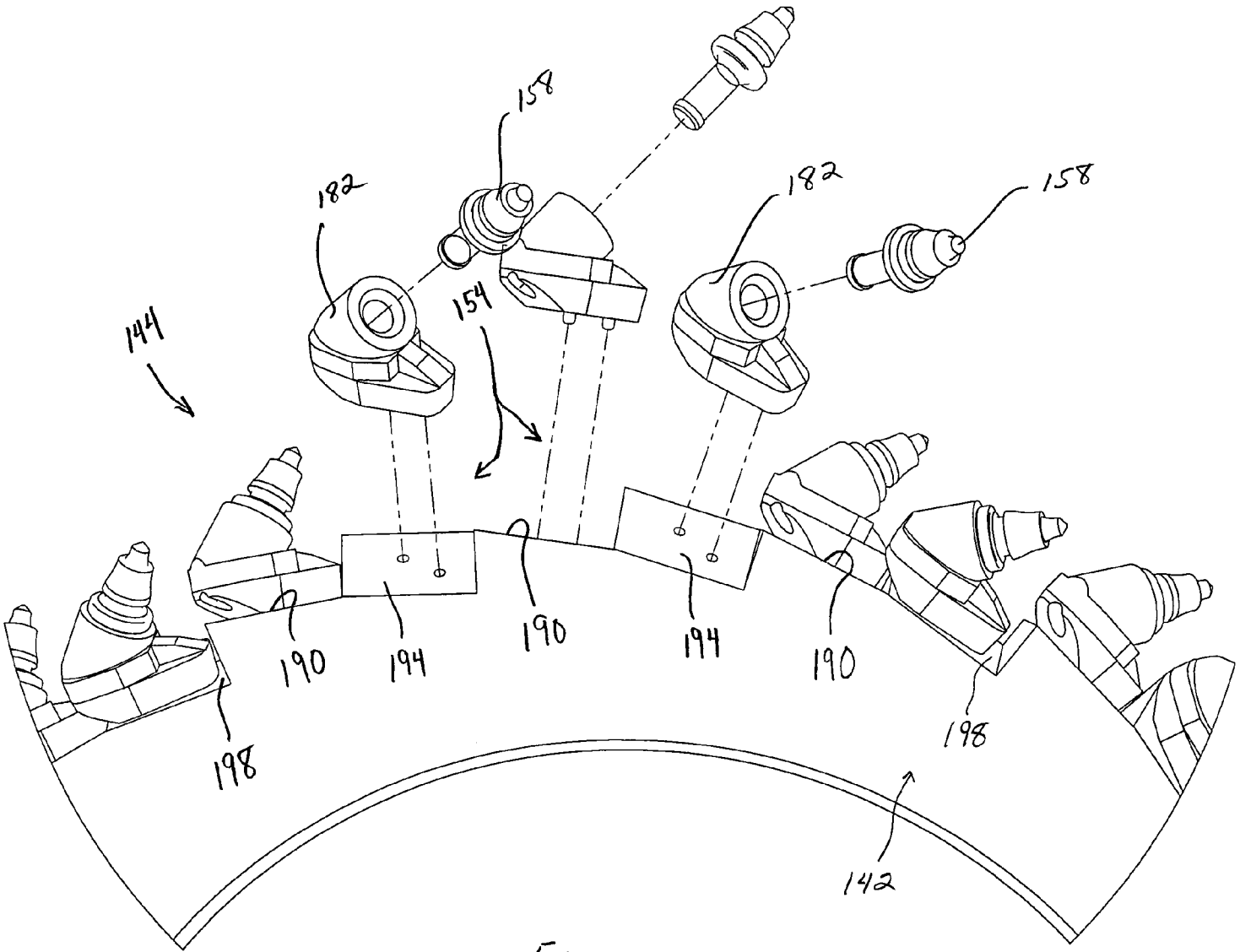
FIG. 23 illustrates a detailed cut-away side view of a support base and the bit locating and patterned bit assemblies according to another exemplary embodiment of the present invention.

FIG. 23 illustrates how the plurality of cutting bits 158 are arranged and coupled to a support base 142 via bit casings 182. More specifically, FIG. 23 illustrates one exemplary embodiment of a bit locating assembly 144 having an exemplary patterned cutting bit assembly 154 thereon. As shown, bit locating assembly 144 is comprised of various shaped cuts, shown as left cut 190, right cut 194, and center cut 198 formed within and positioned annularly about support base 142. Each of cuts 190, 194, and 198 function to dictate and define the respective orientation of cutting bits 158 attached thereto. To attach cutting bits 158, cutting bits 158 are secured within block locators or bit casings 182. Bit casings 182 are subsequently mounted to support base 142, and particularly their respective cuts about support base 142. For example, FIG. 23 shows one cutting bit 158 as it attaches to bit casing 182 which subsequently attaches to left cut 190 of support base 142. Subsequent cutting bits 158 are attached to support base 142 in a similar manner via right cut 194, and center cut 198. Although obvious, it should be noted that left cut 190 functions to orient bit casing 182 as well as cutting bit 158 in a left oriented or left pointing or left angled or left facing position or manner if milling mandrel 10 is viewed from the top. Similarly, right cut 194 orients bit casing 182 and cutting bit 158 in an opposing right oriented or right pointing or right angled or right facing position or manner with respect to milling mandrel 10 which is also viewed from the top. Finally, central cut 198 functions to orient bit casing 182 and cutting 158 in a substantially vertical or upright or perpendicular manner with respect to milling mandrel 10, also viewed from the top.

As FIG. 23 illustrates, left cut 190, right cut 194, and center cut 198 are used multiple times to create patterned cutting bit assembly 154 as arranged about support base 142. The particular pattern of patterned cutting bit assembly 154 may vary, with each of left cut 190, right cut 194, and center cut 198 being utilized in any number, combination, or frequency as desired to come up with a particular cutting bit pattern.

FIGS. 24A–24C illustrate detailed views of bit casing 82 or 182 used to couple and support cutting bits on each support base of each cutting sector of the present invention milling mandrel.

FIGS. 25A–25 illustrate detailed views of bit casing 84 or 184 used to couple and support milling bits located within each milling sector of the present invention milling mandrel.

FIGS. 26A and 26B illustrate detailed views of cutting bits 58 or 158 utilizing in each cutting sector of the present invention milling mandrel.

Figure 27:
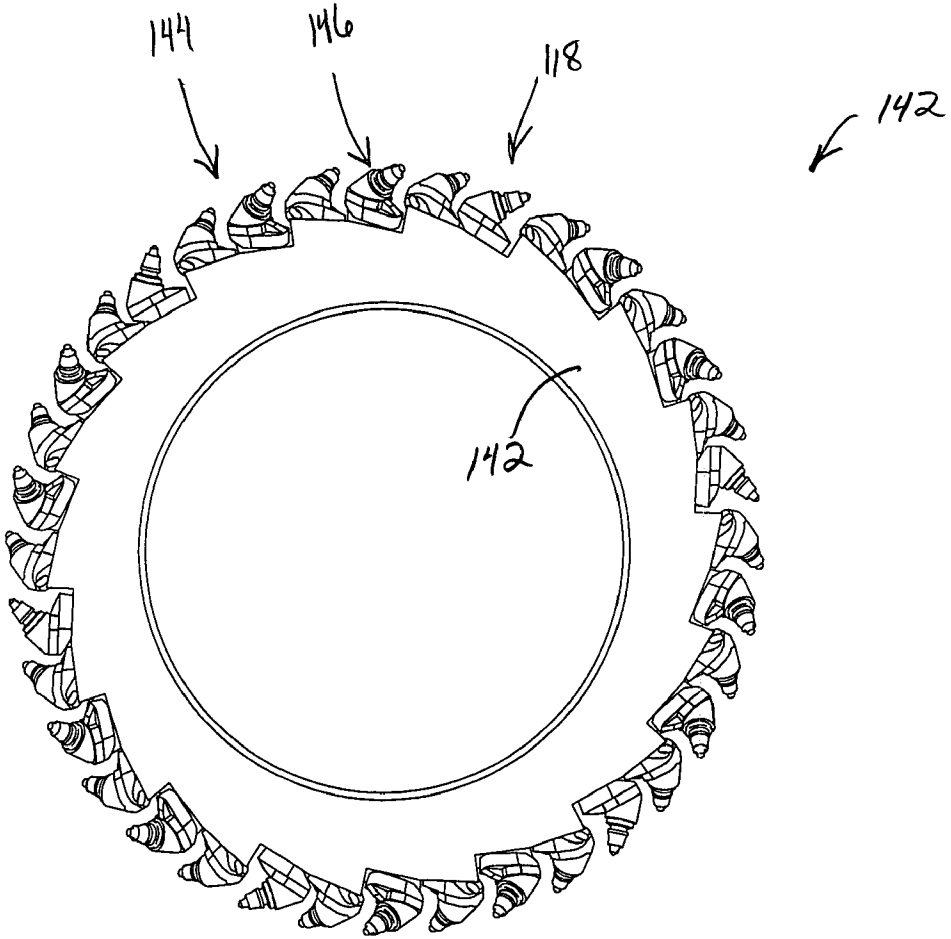
FIG. 27 illustrate a side view of an exemplary cutting section comprising a plurality of cutting bits arranged about a support base according to an exemplary bit location assembly.
Figure 28:
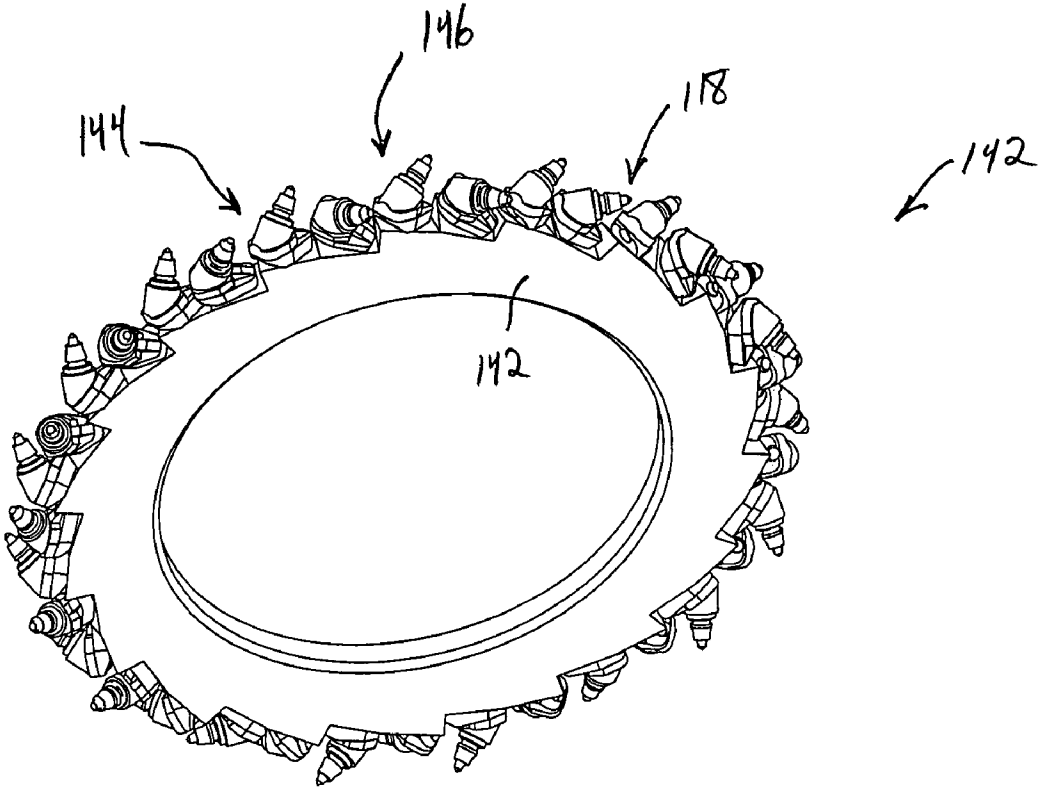
FIG. 28 illustrates a perspective view of the cutting section of FIG. 27.

FIGS. 27 and 28 illustrate one exemplary embodiment of a cutting sector 118 comprising a pre-determined bit locating assembly 144 and patterned bit cutting assembly 148 (or bit pattern) arranged about a support base 142.

An improvement over prior art designs, the present invention milling mandrel comprises a bit location system that helps locate the bits placed on the cutting sectors. Traditionally bits were individually placed on the support base or cutter skin. They were also at offset angles and were tipped and welded to achieve these angles. As this tipping and welding procedure is very inaccurate, the present invention eliminates this via its bit location system. As a result, accuracy was improved and a better system contemplated instead of the tedious and inaccurate tipping welding process.

Another advantage of the present invention milling mandrel is its optional or potential different cutting sector heights. For example, the milling mandrel of the present invention allows the two outer edge-based cutting sectors to comprise a different, and preferably higher, height than the divisional cutting sector. Moreover, the present invention provides cutting sectors that are taller or comprise greater heights than their milling sector counterparts.

The following examples illustrate many of the concepts and features discussed above. These examples are for illustration purposes only and are not intended to be limiting in any way.

EXAMPLE ONE

Each cutting sector was designed 1" taller than the milling sectors so that the cutting sectors could slowly chip thru the rebar existing in our test paving material before the widely spaced center or milling bits could hit under the rebar and tear it out. A 3" area in three places for each cutting sector was cut 34 times before the 17 bits covering 16" of width hit the milling sectors or center. Using this design, the main milling bits are protected from the rebar. In addition, the entire machine is protected from the large reinforced chunks that can potentially deform the dome and break teeth off the milling mandrel or cutter head.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A milling mandrel comprising:

a primary barrel further comprising:

a plurality of cutting bits removably attached to said primary barrel via support bases, and, arranged within one or more cutting sectors;

a plurality of milling bits removably attached to said primary barrel and arranged within one or more milling sectors; and said cutting bits arranged to cut reinforcement materials present in paving materials prior to milling reinforcement materials, said arrangement comprising a pattern selected from the group consisting of right cut, center cut, and left cut.

2. The milling mandrel of claim 1, wherein each said base extends a predetermined distance from said primary barrel and is orthogonal to a surface of said barrel.

3. The milling mandrel of claim 1, wherein each said base extends a predetermined distance from said primary barrel and is oblique to a surface of said barrel.

4. The milling mandrel claim 1, wherein said cutting bits are arranged according to a bit location system.

5. The milling mandrel of claim 1, wherein said bases are spaced so as to optimize a length of cut of reinforcement material for milling.

6. A milling mandrel for cutting pavement reinforcement and milling paving and pavement reinforcement materials comprising:

a primary barrel;

a plurality of milling bits removably attached to said primary barrel;

at least one support base comprising a plurality of flats annularly spaced around the perimeter of a support base, wherein each of the flats comprise a predetermined length capable of receiving at least one bit thereon; and a plurality of cutting bits removably attached to said primary barrel via said at least one support base, wherein said plurality of cutting bits are configured to cut reinforcement materials present in paving materials prior to milling reinforcement materials.

7. The milling mandrel of claim 6, wherein said flats are of an equal length around the perimeter of the support base.

8. The milling mandrel of claim 6, wherein said flats are of differing and varying lengths, and are off-set from the support base.

9. The milling mandrel claim 6, further comprising flat cut sections.

10. The milling mandrel of claim 6, further comprising angled cut sections.

11. The milling mandrel of claim 6, further comprising offset cut sections.

12. The milling mandrel of claim 6, further comprising flat, angled and offset cut sections.

13. The milling mandrel of claim 6, further comprising cut sections that place said cutting bits in an associated position and function to provide a pre-determined, patterned cutting bit assembly and associated bit pattern, selected from the group consisting of left cut, center cut, and right cut.

14. The milling mandrel of claim 6, wherein said base is integrally formed with said primary barrel.

15. The milling mandrel of claim 6, wherein said base is not integrally formed with said primary barrel.

16. The milling mandrel of claim 6, wherein said base extends beyond the a surface of the primary barrel.

17. A milling mandrel for cutting pavement reinforcement and milling paving and pavement reinforcement materials comprising:

a plurality of cutting bits coupled to a support base via bit casings, said plurality of cutting bits arranged to cut reinforcement materials present in paving materials prior to milling reinforcement materials;

one or more bit locating assemblies comprised of various shaped cuts formed within and positioned annularly about a support base and selected from the group consisting of left cut, right cut, and center cut; and a plurality of bit casings wherein said cutting bits are selectively secured about said support base.

18. The milling mandrel of claim 16, wherein one of said assemblies is shaped as a left wedge.

19. The milling mandrel of claim 16, wherein one of said assemblies is shaped as a right wedge.

20. The milling mandrel claim 16, wherein one of said assemblies is shaped as a center wedge.

21. The milling mandrel to claim 16, further comprising a bit receiving surface of said support base.

22. The milling mandrel of claim 16, wherein one of said assemblies is releaseably coupleabled to flats of said support base.

23. The milling mandrel of claim 16, wherein one of said assemblies is arranged in a pattern selected from the group consisting of right cut, center cut, and left cut.

24. The milling mandrel of claim 16, wherein one of said assemblies is arranged in a pattern that is modifiable.

25. The milling mandrel of claim 16, wherein a position and orientation of one of said assemblies is selectively modifiable.

26. A milling system comprising:

a milling device;

powering means for powering said milling system;

attachment means for attaching said milling device to a vehicle;

a milling mandrel releaseably attached to said milling device, said milling mandrel comprising a primary barrel, said barrel further comprising;

a plurality of cutting bits removably attached to said primary barrel via support bases and arranged within one or more cutting sectors;

a plurality of milling bits removably attached to said primary barrel and arranged within one or more milling sectors that are also defined on said primary barrel; and said cutting bits arranged to cut reinforcement materials present in paving materials prior to milling reinforcement materials, said cutting bit arrangement comprising a pattern selected from the group consisting of right cut, center cut, and left cut.

27. The milling system of claim 26, wherein said vehicle is used to propel the milling device.

28. The milling system of claim 26, where said milling system is self propelled.

29. The milling system of claim 26, wherein at least one of said cutting sectors extends substantially orthogonal beyond at least one of said milling sectors.

30. The milling system of claim 26, wherein at least one of said cutting sector is conterminous with at least one of said milling sectors.

31. The milling system of claim 26, wherein at least one of said cutting sectors is positioned to engages pavement reinforcements before at least one of said milling sectors.

32. The milling system of claim 26, wherein said plurality of cutting bits are arranged in a modifiable pattern within a defined cutting sector on said primary barrel.

33. The milling system of claim 26, wherein said mandrel further comprises a patterned cutting bit assembly.

34. The milling system of claim 32, wherein said cutting bits are arranged in a pattern selected from the group consisting of left cut, center cut, and right cut.

35. The milling system of claim 32, wherein said modifiable pattern is selected from the group consisting of left cut, center cut, and right cut.

36. The milling system of claim 32, wherein said cutting sectors are arranged in an identical pattern.

37. The milling system of claim 32, wherein said cutting sectors are arranges in different patterns.

38. A method for cutting and milling reinforced paving materials comprising:

providing a milling device system;

arranging cutting bits in a pattern from the group consisting of right cut, center cut, and left cut;

positioning support base on mandrel;

inserting cutting sector of mandrel into paving materials;

cutting any reinforcement materials present in paving materials prior to milling of reinforcement materials; and milling paving materials with cut reinforcement materials.

* * * * *

UNITED STATES PATENT AND TRADEMARK OFFICE

CERTIFICATE OF CORRECTION

PATENT NO. : 7,066,555 B2
APPLICATION NO. : 10/927864
DATED : June 27, 2006
INVENTOR(S) : Terry Hansen et al.

It is certified that error appears in the above-identified patent and that said Letters Patent is hereby corrected as shown below:

Column 12, line 21, please replace "the milling mandrel claim 1" with --the milling mandrel <u>of</u> claim 1--.

Column 12, line 48, please replace "the milling mandrel claim 6" with --the milling mandrel <u>of</u> claim 6--.

Column 12, line 67, please replace "wherein said base extends beyond the a surface" with --wherein said base extends beyond a surface--.

Column 13, line 18, please replace "the milling mandrel claim 16" with --the milling mandrel of claim 16--.

Column 14, line 17, please replace "positioned to engages pavement" with --positioned to engage pavement--.

Signed and Sealed this

Second Day of October, 2007

JON W. DUDAS
*Director of the United States Patent and Trademark Office*